United States Patent [19]

Graves, Sr.

[11] Patent Number: 4,783,065

[45] Date of Patent: Nov. 8, 1988

[54] FEEDER APPARATUS FOR FEEDING SHEET MATERIAL SECTIONS

[76] Inventor: Glen L. Graves, Sr., 19806 Mueschke Rd., Tomball, Tex. 77375

[21] Appl. No.: 727,908

[22] Filed: Apr. 26, 1985

Related U.S. Application Data

[63] Continuation-in-part of Ser. No. 528,076, Aug. 31, 1983, abandoned, which is a continuation-in-part of Ser. No. 379,701, May 19, 1982, abandoned.

[51] Int. Cl.[4] ..... B65H 29/16

[52] U.S. Cl. ..... 271/151; 271/209; 271/221; 271/3.1

[58] Field of Search ..... 271/3.1, 35, 188, 221, 271/222, 202, 306, 177, 149, 150, 151, 35, 157, 161, 209; 414/35, 36, 907

[56] References Cited

U.S. PATENT DOCUMENTS

| | | | |
|---|---|---|---|
| 415,267 | 11/1889 | Hart | 271/188 |
| 2,931,520 | 4/1960 | Shields | 414/36 |
| 3,143,344 | 8/1964 | Miller et al. . | |
| 3,160,413 | 12/1964 | Faeber . | |
| 3,269,720 | 8/1966 | Schluckebier et al. . | |
| 3,321,202 | 5/1967 | Martin . | |
| 3,361,426 | 1/1968 | Pawlikowski et al. . | |
| 3,410,183 | 11/1968 | Sarka . | |
| 3,422,969 | 1/1969 | Miller et al. | 271/3.1 X |
| 3,476,354 | 11/1969 | Thull et al. | 271/188 |
| 3,507,492 | 4/1970 | Spencer . | |
| 3,522,942 | 8/1970 | Hepp . | |
| 3,522,943 | 8/1970 | Swanson . | |
| 3,674,258 | 7/1972 | Maier et al. . | |
| 3,690,650 | 9/1972 | Maier et al. . | |
| 3,756,591 | 9/1973 | Muller . | |
| 3,761,080 | 9/1973 | Larson . | |
| 3,805,971 | 4/1974 | Behrens et al. | 271/220 |
| 3,881,716 | 5/1975 | Bryson et al. . | |
| 3,897,052 | 7/1975 | Turman et al. | 271/220 |
| 3,953,018 | 4/1976 | Maopolski . | |
| 4,034,974 | 7/1977 | Maopolski . | |
| 4,099,712 | 7/1978 | Martin . | |
| 4,251,000 | 2/1981 | Templeton | 271/209 X |
| 4,295,643 | 10/1981 | de la Vega . | |

FOREIGN PATENT DOCUMENTS

| | | | |
|---|---|---|---|
| 2202334 | 7/1973 | Fed. Rep. of Germany | 271/188 |
| 525679 | 9/1921 | France | 271/209 |
| 244733 | 12/1985 | Japan | 271/161 |
| 1346516 | 2/1974 | United Kingdom | 271/209 |

*Primary Examiner*—Joseph J. Rolla

*Attorney, Agent, or Firm*—Arnold, White & Durkee

[57] ABSTRACT

Feeder apparatus for feeding sheet material sections successively into a receiving hopper from a bundle of stacked sheet material sections. The apparatus includes a receiving section for receiving such bundles and for advancing such bundles. The apparatus further includes a shingling section having a shingling conveyor for receiving such bundles and conveying such bundles along the shingling section, and having a shingling belt system to engage such bundles being conveyed by the shingling conveyor wherein the conveyor and belt system cooperate to shingle the sheet material sections from such bundles into shingled arrangements. The shingling conveyor and shingling belt system are arranged to engage such a shingled arrangement between them and advance such an arrangement in an engaged condition along the shingling section. The apparatus further includes a discharge section for receiving a shingled arrangement from the shingling section, and for discharging such sheet material sections successively into a receiving hopper.

30 Claims, 12 Drawing Sheets

FEEDER APPARATUS FOR FEEDING SHEET MATERIAL SECTIONS

BACKGROUND OF THE INVENTION

This application is a continuation-in-part application of my copending application Ser. No. 528,076 filed Aug. 31, 1983, now abandoned, which was a continuation-in-part of application Ser. No. 379,701 filed May 19, 1982, now abandoned.

This invention relates to feeder apparatus. More particularly, this invention relates to feeder apparatus for use in feeding sheet material sections successively to a receiving zone. This invention further relates to certain aspects of such feeder apparatus.

The feeder apparatus of this invention can have application in regard to the feeding of various types of sheet material sections It can, however, have particular application in regard to the feeding of folded sheet material sections, such as, for example, newspaper sections or signatures.

Feeder systems are particularly required in the newspaper industry to handle bundles of stacked folded newspaper sections and feed such newspaper sections to a receiving hopper or receiving head of an insertion machine or the like, where such sections can be inserted assembled and stacked in bundle form. These preprinted sections must then later be supplied to an insertion machine for insertion into the outer jackets or outer sections of later printed sections or jackets.

In the newspaper industry, preprinted sections are usually stacked by means of a counter-stacker into bundles. If these bundles constitute insert sections, these insert sections are then conveyed in bundle form to an insertion machine for later insertion into other printed sections. These prestacked bundles are frequently handled manually between a source of such bundles and the receiving or head hoppers of any conventional form of insertion machine. Such manual handling is time consuming and labor intensive. It further requires that each handler pick up a relatively small bundle of stacked and folded newspaper sections, that each handler then square the sections fairly accurately, and that each handler then lift the squared bundle and place it manually in an elevated receiving hopper or head of an insertion machine. This operation is necessary so that the extraction mechanism of an insertion machine can extract each folded section in turn.

Attempts have been made to eliminate or reduce the amount of manual handling which is necessary. For example, U.S. Pat. No. 3,690,650 to Maier, Jr. et al. discloses an apparatus for feeding sheet material into a hopper. That apparatus includes a conveyor system which delivers bursts of shingled sheet material into a hopper where they are squared by joggers However, this system still needs a person to shingle the stacked material after it is placed on the conveyor system.

Additionally, with newspapers, many of the preprinted inserts are smaller in size than the rest of the newspaper and are printed on paper having a slick surface Accordingly, as the sections containing these inserts are shingled, the inserts often slide out of place.

Accordingly, there is a need in the art for an apparatus which can overcome the disadvantages of the prior art and provide a means for effectively loading stacked sheet material into the receiving hopper of an insertion machine or the like. Such as apparatus is disclosed and claimed herein.

BRIEF SUMMARY OF THE INVENTION

The present invention is directed to a feeder apparatus for feeding sections of stacked sheet materials such as newspaper sections into a receiving hopper on a newspaper insertion machine or other similar type of apparatus. The feeder apparatus includes a receiving zone onto which bundles of stacked sheet material are loaded. A shingling section receives the bundles from the receiving section and arranges the bundle into a shingled arrangement while preventing slippage of any of the preprinted inserts in the sections. From the shingling section, the sheet material is fed to a discharge section which successively feeds the sheet material into a receiving hopper in such a way that the sections can easily be squared for further processing.

In a preferred embodiment, the receiving section includes a conveyor system onto which the bundles of stacked sheet material can be either manually or automatically placed. The length of the receiving section is such that it can accommodate about two bundles of stacked sheet material. The receiving section includes a conveyor which successively feeds bundles to the shingling section after the previous bundle passes therethrough.

The shingling section receives the bundles of stacked material and shingles the sections successively out from the bottom thereof. The shingling section includes a conveyor system which is supported by a series of floating rollers. The conveyor system sequentially engages the sections of stacked material from the bottom of the stack and carriers them forward through the shingling section to the discharge section.

The shingling section also includes a belt system for engaging the shingled arrangement to hold the sections against the conveyor system. In the preferred embodiment, the belt system comprises a series of helical springs which are driven by a plurality of rollers. The belt system holds the sections of newspaper under compression against the conveyor system to prevent the inserts from becoming dislodged as the sections pass through the feeder apparatus. Additionally, by holding the sections in compression, the belt system helps to squeeze air out from between the pages in the section to facilitate stacking and squaring as more fully discussed hereinafter.

In a preferred embodiment, the belt system includes a pivotable hold down arm at the entrance of the shingling section. As a fresh bundle of stacked material enters the shingling section, it causes the hold down arm to pivot forward and upwardly such that it substantially rests upon the top of the bundle. The hold down arm exerts pressure upon the bundle to prevent it from toppling backwards under its own weight which could cause the sections in the bundle to become disarrayed and could cause the inserts to become dislodged.

As the sections are shingled out from the bottom of the stack, they are wedged between the conveyor system and the belt system. The belt system includes a plurality of rollers which drive the belts at substantially the same linear speed as the conveyor such that the sections are held in a fixed relationship as they pass through the shingling section. The lower rollers of the belt system which engage the top of the shingled sections are attached to pivotable support arms. These rollers are biased downwardly against the top of the shingled sections. However, if thicker sections are shingled through the feeder apparatus, these rollers can move upwardly to allow the thicker sections to pass therethrough. Accordingly, the system automatically adjusts to the thickness of the sections being shingled to maintain the proper compressive force to hold them in place.

From the shingling section, the sections of newspaper are passed to the discharge section where they are successfully discharged into the receiving hopper on an insert machine or the like. The discharge section works in cooperation with the receiving hopper to stack and align the sections in such a manner that they can be subsequently handled by the insert machine.

In the preferred embodiment, the discharge section discharges the newspaper sections in a substantially horizontal position. The newspaper sections then enter the receiving hopper where a series of vertical belts engage the sides of the newspaper section and lower it to the bottom of the receiving hopper in an aligned manner. Inasmuch as the newspaper sections are engaged by belts on both sides of the receiving hopper, it is necessary to reduce the width of the newspaper sections as they enter the receiving hopper such that they do not prematurely strike the sides of the receiving hopper and become misaligned. In the preferred embodiment, this is accomplished by an offset roller which creates a small hump in the center of the newspaper section longitudinally as it passes through the discharge section. This hump causes the overall width of the section to be temporarily reduced. As the newspaper section is released from the discharge section, the force of the roller is removed and the newspaper section resumes its normal flat position such that the sides of the section engage the belts on the sides of the receiving hopper which lower and align the newspaper section within the hopper.

In a second preferred embodiment, the feeder apparatus may include at least one intermediate section between the receiving section and the shingling section to convey bundles from the receiving section to the shingling section. The intermediate section is preferably such that it forms a gradual transition between the receiving section and the shingling section when the hold down arm is not used to prevent the toppling of bundles of sheet material sections while they are being conveyed from the receiving section to the shingling section.

In another preferred embodiment, the receiving hopper is provided with joggers rather than belts and the discharge section is preferably adapted to discharge each sheet material section with its central zone in the direction of movement of such sheet material section being depressed below its opposed edges. The object hereof is to insure that each discharged sheet material section drops into a receiving hopper in the same depressed configuration thereby combating the tendency for the opposed edges of the sheet material section to slip downwardly down the side of a stack of sections below that sheet in the receiving hopper or head.

The discharge belt system may preferably be positioned to so depress the central regions of successive sheet material sections discharged from the discharge section. The discharge belt system may further conveniently extend beyond the discharge end of the discharge conveyor to impart a downwardly direct component to each sheet material section upon discharge.

The feeder apparatus of this invention preferably includes or is adapted to be used with a receiving hopper for receiving sheet material sections discharged from the apparatus.

While the receiving hopper may be a hopper of any conventional type for receiving sheet material sections for purposes such as folding, storing, trimming, binding or labeling, it is preferably in the form of a receiving hopper or head of a conventional type of insertion machine for inserting folded newspaper sections into other folded newspaper sections thereby forming a composite newspaper for delivery comprising an outer-folded jacket, and a plurality of folded insert sections which are located therein.

The receiving hopper in one embodiment includes a side jogger positioned adjacent the discharge end of the discharge conveyor for jogging sheet material sections discharged into the hopper.

The receiving hopper may preferably include further squaring means for squaring sheet material sections discharged into the hopper. In one embodiment of the invention, the further squaring means comprises a pair of rear joggers which are adapted to be jogged out of phase to achieve effective squaring. They may conveniently be jogged say 90 degrees or 180 degrees out of phase.

In the preferred embodiment, all sides of the receiving hopper are provided with ribbed belts which engage the edges of the newspaper sections and direct them in an aligned relationship to the bottom of the hopper.

DETAILED DESCRIPTION OF THE PREFERRED EMBODIMENTS

Figure 1:
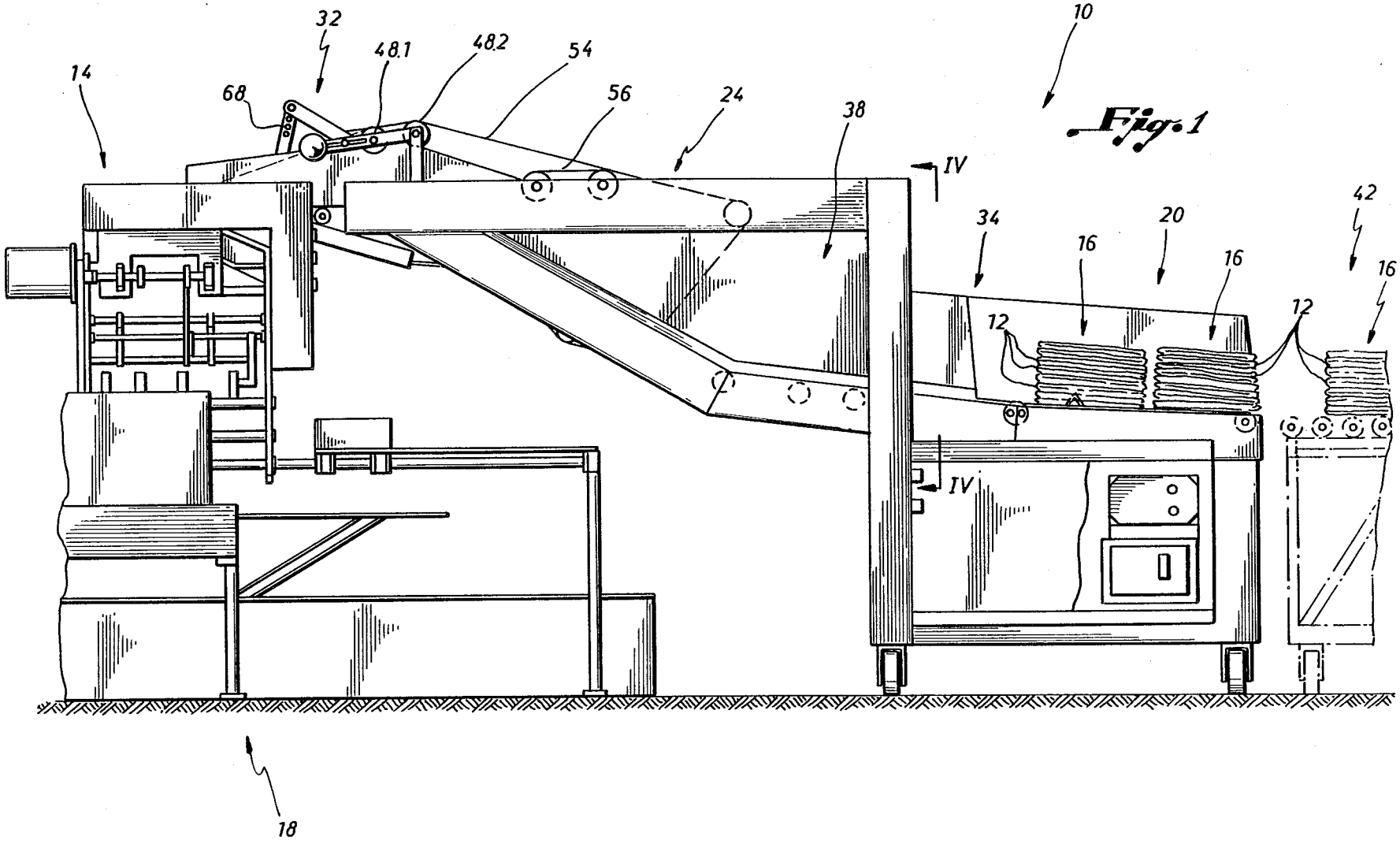
FIG. 1 shows a fragmentary, diagrammatic, side elevation of one embodiment of a feeder apparatus in accordance with this invention, in its operative position for feeding folded newspaper sections into an insertion machine of conventional type.

With reference to FIGS. 1 to 6 of the drawings, reference numeral 10 refers generally to a feeder apparatus for use in feeding sheet material sections 12 successively up into a receiving hopper 14 from a bundle 16 of stacked sheet material sections 12.

The feeder apparatus 10 illustrated in the drawings, is an apparatus which is particularly suitable for the handling of sheet material sections 12 in the form of folded newspaper sections 12.

The folded newspaper sections 12 can be single folded sections. However, the feeder apparatus 10 is particularly useful for feeding composite folded newspaper sections 12 comprising a plurality of preinserted sections. The composite folded newspaper sections 12 are delivered to the feeder apparatus 10 in bundles 16 of stacked newspaper sections 12. The newspaper sections 12 are then fed from such bundles 16 to a receiving hopper or head 14 of any conventional type of appropriate insertion machine 18. In such hoppers such folded newspaper sections 12 are taken one at a time by appropriate extraction means from receiving hoppers 14 and are inserted into other folded sections which are held in an open condition in insertion hoppers in an opener section of the insertion machine 18.

Bundles 16 of folded newspaper sections 12 are difficult to handle automatically particularly when the newspaper sections 12 are relatively thick, have preinserted sections with different numbers of pages, or which are formed out of paper stock having differing widths, finishes or textures. If such a bundle is elevated by conveying means and is allowed to topple under its own weight purely as a result of the angle of the conveying means, haphazard toppling almost invariably occurs. Such haphazard toppling will usually result in inserted sections sliding out of their outer section. This results in a disarrayed shingle arrangement which cannot be fed effectively into a receiving hopper 14 for subsequent extraction as single sections 12 for transference into the insertion machine opener section.

The feeder apparatus 10 is designed to provide for controlled shingling of the bundles 16 so that the apparatus can handle folded newspaper sections which include inserts, and can handle folded newspaper sections 12 which include inserts of different weights, finishes and textures.

The feeder apparatus 10 comprises a receiving section 20 for initially receiving such bundles 16 of stacked folded newspaper sections 12, the receiving section 20 including a receiving conveyor 22 for advancing bundles 16 along the apparatus 10.

The feeder apparatus 10 further comprises a shingling section 24 including a shingling conveyor 26 for receiving such bundles 16 advanced by the receiving section 20, and for conveying such bundles upwardly along the shingling section 24. The shingling conveyor 26, in one preferred embodiment, extends upwardly at a slope of 30°, so that for the types of bundles 16 to be handled by the apparatus 10, the shingling conveyor 26 can convey such bundles 16 upwardly along the shingling section 24 without the bundles 16 toppling.

Figures 2, 3, 3A:
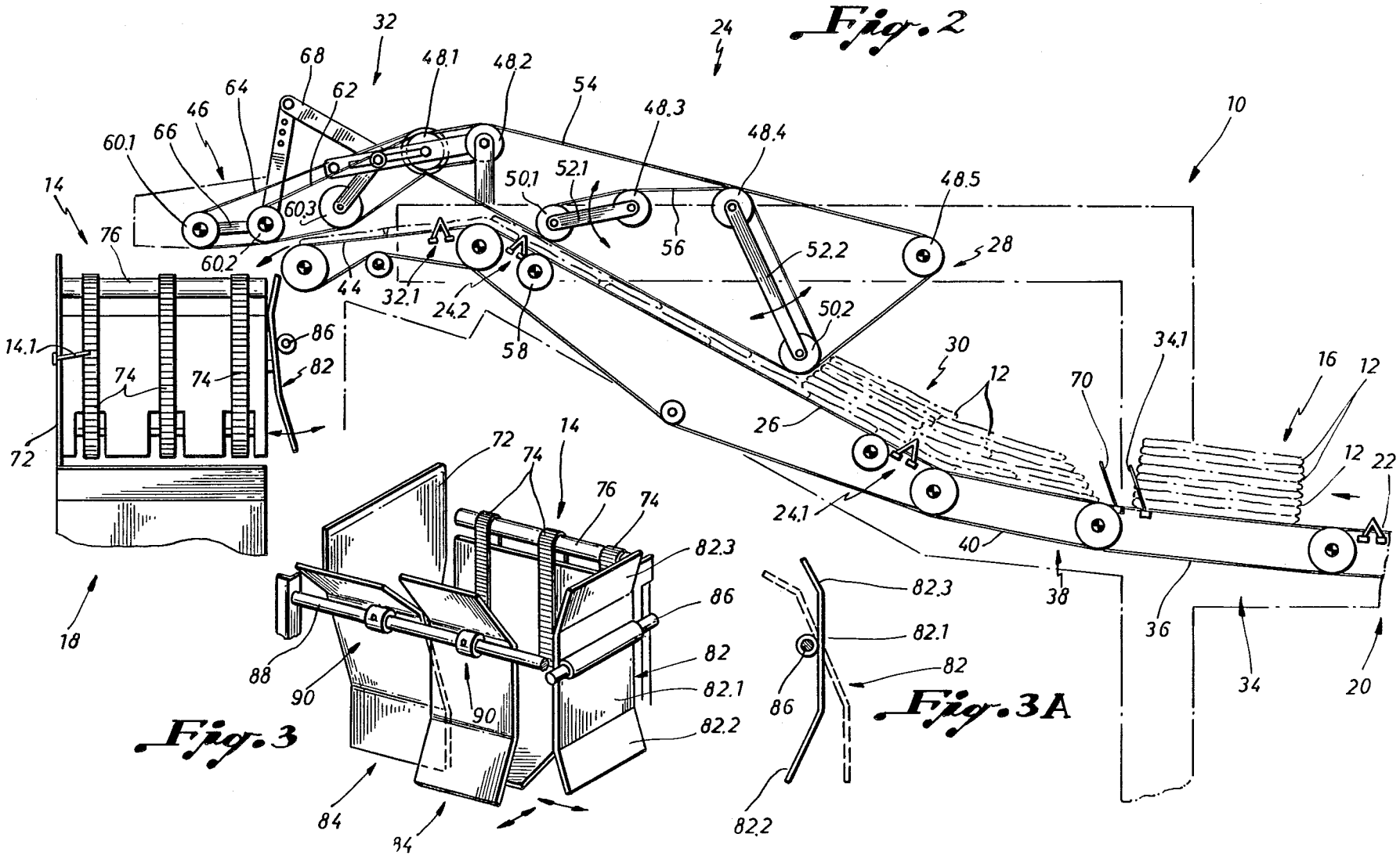
FIG. 2 shows a fragmentary, diagrammatic, side elevation of part of the feeder apparatus of FIG. 1, with cover plates and frame sections omitted for the sake of clarity.
FIG. 3 shows a diagrammatic, fragmentary oblique view from the rear and from one side, of the receiving hopper or head of the insertion machine of FIGS. 1 and 2.
FIG. 3A shows a diagrammatic side elevation of the side jogger of the receiving head of FIG. 3.

The shingling section 24 further includes a shingling belt system 28 which is positioned relatively to the shingling conveyor 26 to engage a bundle 16 being advanced by the shingling conveyor 26 and cause such a bundle 16 to move into a shingled arrangement 30 (as shown in FIG. 2).

The shingling belt system 28 cooperates with the shingling conveyor 26 to engage such a shingled arrangement 30 and advance such arrangement 30 in an engaged shingled condition upwardly along the shingling section 24.

Because the shingled arrangement 30 is engaged between the belt system 28 and the shingling conveyor 26, the inserted sections of the newspaper sections 12 will be held in position and will not readily slip out or become disarrayed during such advance of the shingled arrangement 30.

The apparatus 10 further includes a discharge section 32 for receiving such a shingled arrangement 30 from the shingling section 24, and for discharging the folded newspaper sections 12 successively into the receiving hopper or head 14.

The apparatus 10 further includes an intermediate section between the receiving section 20 and the shingling section 24 to convey bundles 16 from the receiving section 20 to the shingling section 24.

The intermediate section comprises a first intermediate section 34 having a conveyor 36, and a second intermediate section 38 having a conveyor 40.

The conveyor 36 leads from the receiving conveyor 22 to the conveyor 40, whereas the conveyor 40 leads from the conveyor 36 to the shingling conveyor 26.

The receiving section 20 may be generally horizontal or may slope upwardly at an angle of less than about 4°. In one embodiment of the invention, it will have an upwardly sloping angle of about 4°.

The first intermediate section 34 slopes upwardly at an angle of at least about 5° and preferably more. The second intermediate section 38 slopes upwardly at an angle of about 10°, and preferably between about 8° and about 20°.

The intermediate sections 34 and 38 therefore form a smooth sloping transition between the receiving section 20 and the shingling section 24 thereby further reducing any tendency for uncontrolled toppling to occur while a bundle 16 is being conveyed from the receiving section 20 to the shingling section 24.

With the feeder apparatus 10 designed to handle newspaper sections 12 of conventional size and shape in the first illustrated embodiment of this invention, the receiving section 20 is shown having a length of about 36 inches so that it can comfortably hold two bundles 16 in end to end relationship as shown in FIG. 1.

In the feeder apparatus 10, each of the first and second intermediate sections 34 and 38 has a length of about 18 inches so that it can comfortably handle one bundle 16.

The shingling section has a length of about 36 inches, whereas the discharge section 32 has a length of about 18 inches.

The feeder apparatus 10 may be fed manually by a handler placing bundles 16 on the receiving section 20 as and when required. Alternatively, if desired, the feeder apparatus 10 may be fed automatically from any feeding conveyor system such as, for example, a conveying system 42 as illustrated in FIG. 1. In practice, preprinted sections would be assembled into bundles 16 and would be conveyed by the conveying system 42 to the receiving section 20 or would be manually placed on the receiving section 20. For currently printed sections, a counter stacker could stack the newspaper sections 12 into bundles 16 and send them straight through on an appropriate conveying system 42 to the receiving section 20.

The receiving section 20 preferably has a pair of conveyor belts which constitute the receiving conveyor 22.

Each of the intermediate sections 34 and 38 preferably has three conveyor belts constituting the conveyors 36 and 40 respectively.

The shingling section 24 preferably has four conveyor belts constituting the shingling conveyor 26.

The discharge section 32 in the illustrated embodiment comprises a discharge conveyor 44 and a discharge belt system 46.

The discharge conveyor 44 in the illustrated embodiment preferably slopes downwardly at an angle of about 2° and is made up of three conveyor belts.

The shingling belt system 28 includes a plurality of idler rollers 48.1, 48.2, 48.3 and 48.4 which are mounted on the frame of the apparatus 10 for free rotation. The shingling belt system 28 further includes a driven roller 48.5 which is driven to drive the shingling belt system 28.

The shingling belt system 28 further includes two floating rollers 50.1 and 50.2. The floating roller 50.1 is pivotally associated with the idler roller 48.3 by means of a pair of pivot arms 52.1; while the floating roller 50.2 is pivotally connected to the idler roller 48.4 by means of a pair of pivot arms 52.2.

The rollers 48.1, 48.2, 48.3, 48.4, 50.2 and 50.1 are rotatably connected by means of a plurality of endless helical spring belts 54 which are located in axially spaced grooves in the various rollers.

The rollers 50.1, 48.3, 48.4 and 50.2 are likewise rotatably connected by means of a separate set of a plurality of endless helical spring belts 56. The spring belts 56 tend to bias the floating rollers 50.1 and 50.2 inwardly towards each other, thereby biasing the floating rollers 50.1 and 50.2 resiliently towards the shingling conveyor 26. At the same time, the floating rollers 50.1 and 50.2 will bias the spring belts 54 into contact with the shingling conveyor 26.

The conveyor belts which constitute the shingling conveyor 26 are unsupported in the region of the floating roller 50.2. Thus when sections 12 of a shingled arrangement 30 are drawn into the throat region between the floating roller 50.2 and the shingling conveyor 26, the belts can yield in that zone to allow ready admittance of the shingled arrangement 30, and to allow such shingled arrangement 30 to be moved upwardly along the shingling section 24 while the newspaper sections 12 of the shingled arrangement 30 are held in firm engagement between the spring belts 54 of the shingling belt system 28 and the conveyor belts of the shingling conveyor 26.

A floating support roller 58 supports the shingling conveyor 26 in the region of the floating roller 50.1 to again accommodate pressure provided on the shingling conveyor 26 by the floating roller 50.1 during use. This, therefore, again accommodates smooth transmission of newspaper sections 12 of a shingled arrangement 30 through the shingling section 24.

The discharge belt system 46 includes the idler roller 48.1, and three discharge rollers 60.1, 60.2 and 60.3.

The idler roller 48.1 is connected to the discharge rollers 60.2 and 60.3 by means of an endless helical spring belt 62. The idler roller 48.1 is further connected to the discharge rollers 60.1, 60.2 and 60.3 by means of an endless helical spring belt 64.

The belts 62 and 64 run over an enlarged diameter section of the idler roller 48.1 thereby ensuring that the belts 62 and 64 will be driven at a faster rate than the belts 54 and 56.

The discharge roller 60.3 is spring biased in a downward direction into engagement with the discharge conveyor 44.

The discharge roller 60.1 extends from an arm 66 connected to the axle of the discharge roller 60.2, whereas the discharge roller 60.2 has its axle mounted on a lever arm 68. The lever arm 68 is adjustable to adjust the extent by which, the discharge rollers 60.1 and 60.2 project beyond the discharge conveyor 44. The lever arm 68 is weighted to ensure that the discharge rollers 60.1 and 60.2 are biased downwardly.

Figure 4B:
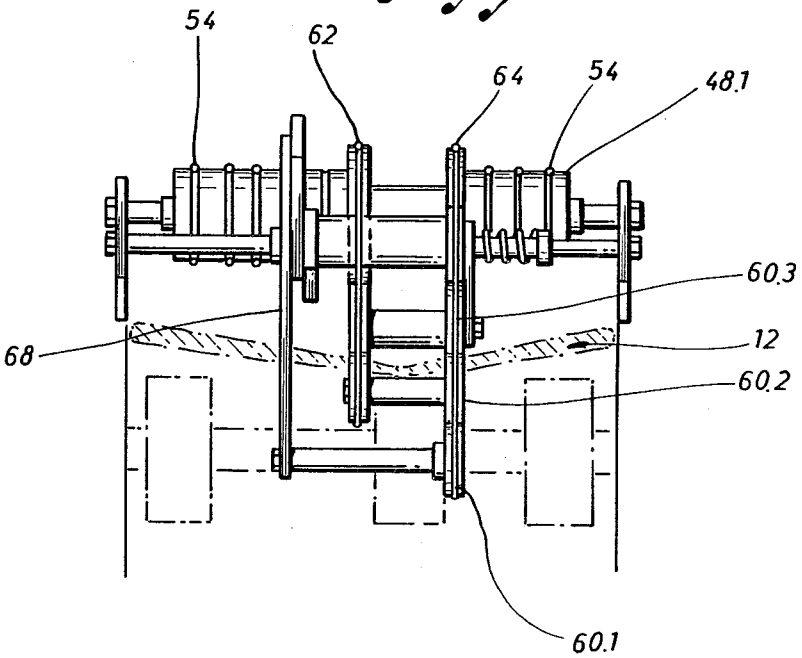
FIG. 4B shows a fragmentary diagrammatic front view of the feeder apparatus of FIG. 1, of the discharge end of the discharge section of that apparatus.

As can be seen particularly in FIG. 4B of the drawings, the discharge rollers 60 and their belts 62 and 64 depress each section 12 advanced through the discharge section 32, along its central zone. Thus the central zone of each section 12 is depressed along a line in the direction of movement of the section 12 through the discharge section 32. This ensures that each section 12 discharged from the discharge section 32 has its central zone depressed and its opposed edges (again in the direction of movement of the section 121 raised relatively to the depressed central region.

This depressed or flat generally V-section configuration provides the advantage that each section 12 will drop into the receiving hopper 14 with a much reduced tendency for the opposed edges to slip downwardly down the sides of a stack of sections 12 which are already in the hopper 14.

This provides the further advantage that the squaring belt system which tends to draw the sections 12 into the hopper 14, as is hereinafter described, will not tend to draw the edge of a section 12 in contact therewith, down below the plane of that section 12 when it comes to rest in the receiving hopper or head 14.

The receiving hopper or head 14 includes a demand switch 14.1. The switch 14.1 senses the level of newspaper sections 12 in the receiving head 14.

Once the level in the receiving head 14 has dropped sufficiently to expose the demand switch 14.1, it will demand a further supply of newspaper sections 12.

In the embodiment illustrated in the drawings, all sections will stop operating unless a demand for further operation is made. In an alternative embodiment of the invention, however, the apparatus 10 can be operated such that the discharge section 32 is in continuous operation regardless of whether or not any demand has been made by the demand switch 14.1 for further supplies. This continuous operation of the discharge section 32 ensures that there are no newspaper sections 12 hanging therefrom when the demand has ceased. For this alternative embodiment, separate drive means will be provided to drive the discharge conveyor 44 and the belts 62 and 64 of the discharge section.

However, in the embodiment illustrated in the drawings, when the demand switch 14.1 demands a further supply of newspaper sections 12, the conveyor belts of the discharge section 32, of the shingling section 24 and of the first and second intermediate sections 34 and 38 will run to feed sections 12 and shingled sections in a shingled arrangement 30 to the receiving head 14.

The shingling section 24 includes a shingling demand switch 24.1. As soon as the demand switch 24.1 is no longer covered and is therefore no longer depressed by the weight of a section 12, it starts operation of the first intermediate section 34 to feed a further bundle 16 to the second intermediate section 38. While this operation is occurring, the discharge section 32, the shingling section 24, and the second intermediate section 38 will continue to run in response to the requirements of the demand switch 14.1, until a control switch 32.1 of the discharge section 32 and a control switch 24.2 of the shingling section 24 are covered by a fresh supply of newspaper sections 12. Once these control switches 32.1 and 24.2 become covered, they will be depressed to cause stoppage of further operation of the discharge section 32 and shingling section 24 and second intermediate section 38 until a further demand is made by the demand switch 14.1 of the receiving head 14.

The first intermediate section 34 includes a demand switch 34.1. Unless this demand switch 34.1 is depressed by a bundle 16 at the time when the demand switch 24.1 calls for a further supply, it will cause the receiving section 20 to operate to supply a further bundle 16 to the first intermediate section 34.

Once a bundle 16 has cleared the demand switch 34.1 of the first intermediate section 34, the demand switch 34.1 will cause the receiving section 20 to operate to replace the bundle 16 on the first intermediate section 34.

Once control switch 32.1 is depressed, it stops further operation of the discharge section 32, the shingling section 24 and the second intermediate section 38.

If the demand switch 24.1 is not covered when demand switch 14.1 demands a further supply, it will cause the first intermediate section 34 to operate as well. The control switch 24.2 has the function of preventing this automatic operation of the first intermediate section 34 until control switch 24.2 has been uncovered and is no longer depressed.

The second intermediate section 38 includes a pivotally mounted backstop 70 which acts as a backstop to prevent sections 12 from sliding back onto the first intermediate section 34 if a large bundle 16 is shingled by the shingling section 24. If a large bundle 16 is conveyed upwardly by the shingling conveyor 26 and comes into contact with the shingling belt system 28, it will be shingled with the lowermost sections 12 being drawn upwardly into the throat formed between the floating roller 50.2 and the shingling conveyor 26. If the bundle 16 is particularly large, such shingling action can cause shingling back onto the second intermediate section 38. In this event, the backstop 70 will prevent uncontrolled shingling back onto the first intermediate section 34.

In the shingling section 24, the conveyor belts of the shingling conveyor 26 would be driven at the same rate as the spring belts 54 and 56 of the shingling belt system 28. Shingling therefore results from the belts 54 pushing the upper sections 12 of a bundle 16 backwards to assist shingling, while the shingling conveyor 26 in cooperation with the belt system 28 draws the lowermost sections 12 of such a bundle into the throat and upwardly along the shingling conveyor 26.

While any suitable electric motor with appropriate gearing may be employed to operate the various systems of the apparatus 10, a one-horse power Woods electric motor may conveniently be employed to drive all systems.

While the speeds may be varied for various types of sections 12 and for various conditions, in one preferred embodiment of the invention the speeds may be as follows.

Taking the speed of the receiving conveyor 22 as the base speed, the speeds of the remaining sections will be adjusted as follows:

(a) speed of conveyor 36 in intermediate section 34=base speed plus 5%;

(b) speed of conveyor 40 of second intermediate section 38=speed of conveyor 36 plus 15%;

(c) speed of shingling conveyor 26 and endless spring belt 54=speed of conveyor 40 plus 40%; and (d) speed of discharge conveyor 44 and discharge belt system 46=speed of shingling conveyor 26 plus 5%.

For practical operation of the apparatus 10, it preferably includes a single control system to control the operation of the base speed of the receiving conveyor 22. Variations of this base speed will automatically vary the speeds of the remaining sections to keep within the required percentage factors.

In the discharge section 32, the speed of operation is sufficient to forcibly eject the sections 112 into the receiving hopper 14. Because of the variation in speed of each successive section, the bundles 16 will separate further from each other as they are advanced along the apparatus 10. At the same time, the shingled sections 12 will become more separated as they move from the shingling section 24 to the discharge section 32. This facilitates discharge of the sections 12 one by one into the receiving head 14 for stacking therein in a sufficiently squared stack for handling by the insertion machine 18. The receiving head 14 is similar to the conventional receiving head of an insertion machine 18 having a plurality of circumferentially spaced receiving heads in an annular configuration, and having extraction means of conventional type for such machines to extract sections one by one from the receiving heads 14, and to feed them into opened sections which are held in insertion hoppers of the machine 18.

Figure 4A:
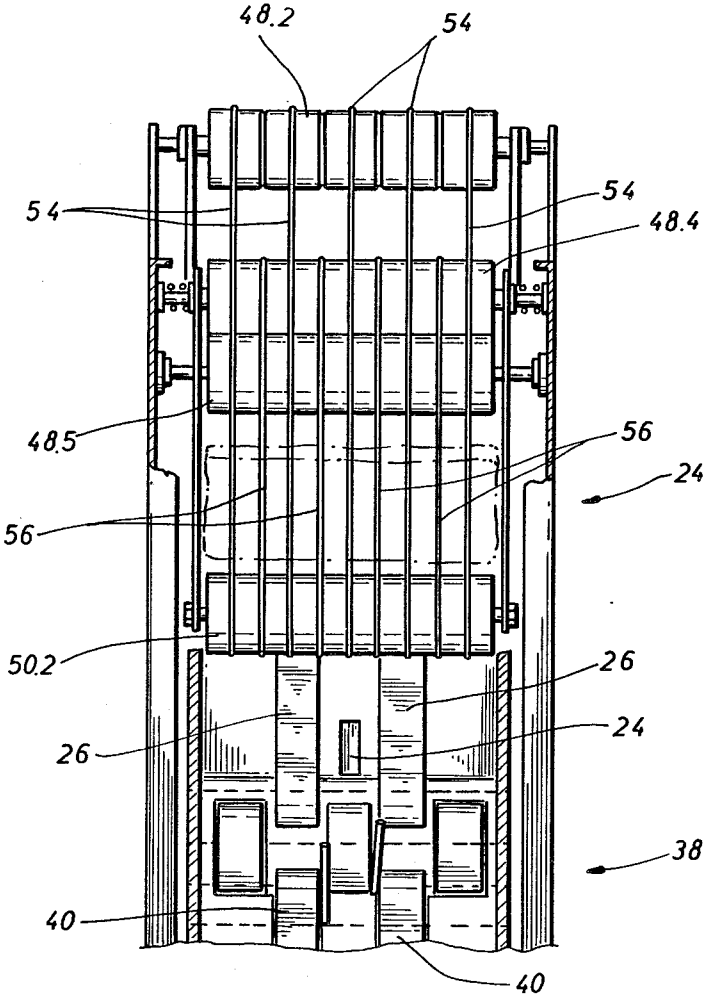
FIG. 4A shows a fragmentary view of the feeder apparatus along the line and in the direction of the arrows associated with the line IV—IV in FIG. 1.
Figure 6:
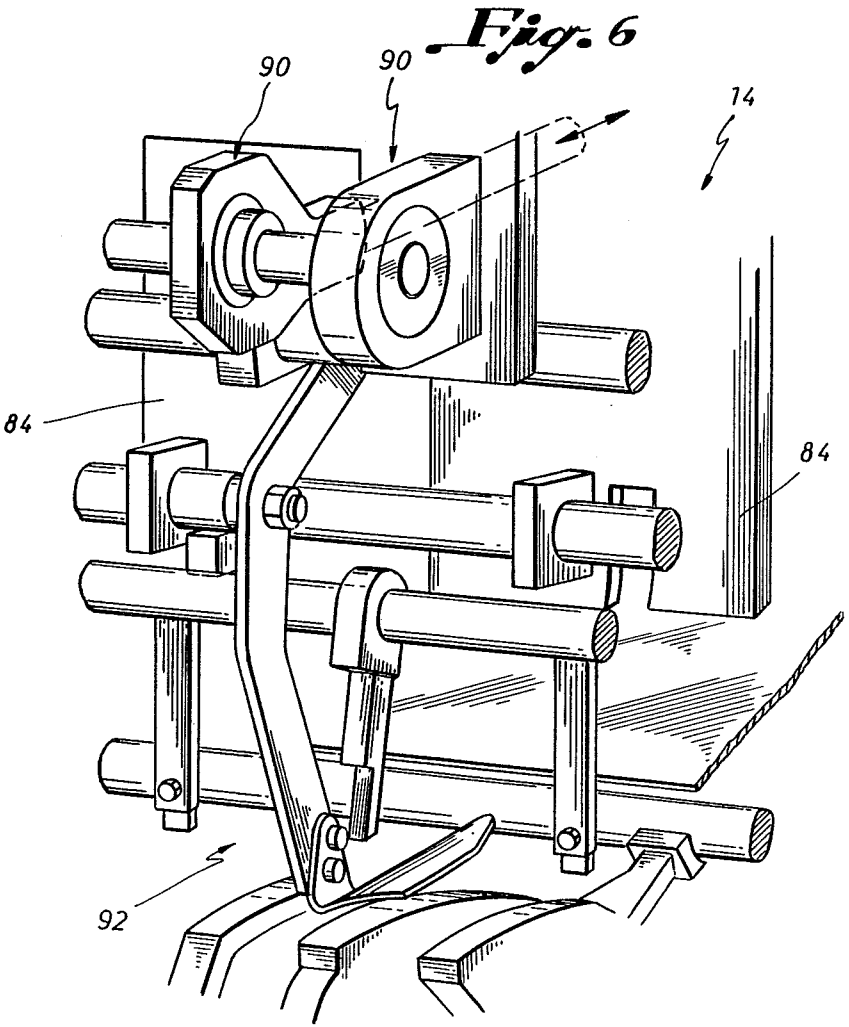
FIG. 6 shows, to an enlarged scale an oblique rear view of the receiving head of FIG. 5.
Figure 5:
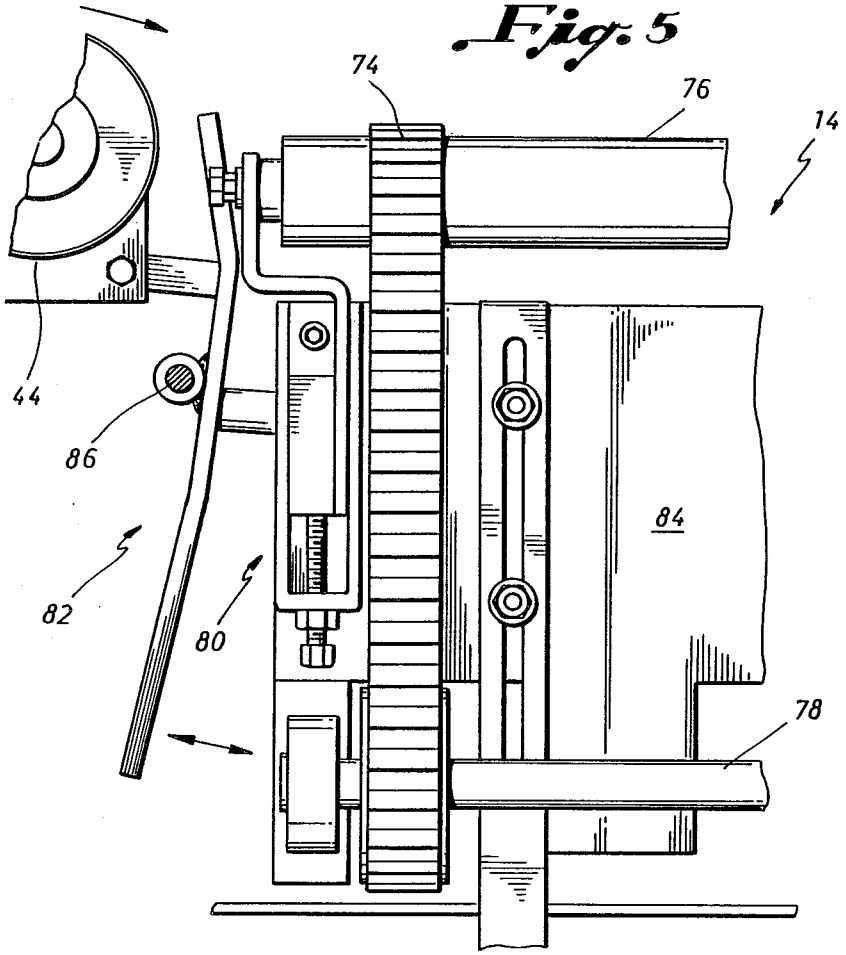
FIG. 5 shows, to an enlarged scale, a fragmentary side elevation of the receiving head or hopper of FIG. 3 associated with the feeder apparatus.

As can be seen particularly in FIGS. 2, 3, and 4, and in more detail in FIGS. 5 and 6 of the drawings, the receiving head 14 includes a sidewall 72 which is fixed, and in which the demand switch 14.1 is provided.

The receiving head 14 further includes ribbed belts 74 which are mounted on a pair of laterally spaced rollers 76 and 78 to be driven during use. The receiving hopper 14 includes adjustment means 80 of conventional type to adjust the tension of the belts 74. In use, the rollers 78 are driven to rotatably drive the ribbed belts 74 and thereby cause them to engage the open end of a folded section 12 discharged by the apparatus 10 and thereby fling each folded section 12 downwardly into the receiving hopper 14 while providing a squaring action.

Each receiving hopper 14 includes a side jogger 82 and a pair of rear joggers 84.

The side jogger 82 and the pair of rear joggers 84 are vibrated during use to provide a squaring effect for squaring the sections 12 as they are discharged into the receiving head 14 and as they settle therein. This squaring action of the side jogger 82 and the rear joggers 84 is complementary to the squaring action provided by the ribbed belts 74.

The side jogger 82 is mounted on an axle 86 whereas the rear joggers 84 are mounted on an axle 88. The mounting is such that two-fifths of the side jogger is above the axle 86 and the remaining three-fifths below that axle. The rear joggers are mounted on the axle 88 which is positioned somewhat higher than the axle 86.

The side jogger 82 has a central panel 82.1, a lower panel 82.2 extending at an angle from the central panel 82.1, and an upper panel 82.3 which again extends at an angle from the central panel 82.1. The side jogger 82 is adapted to be vibrated between two extremes where the lower panel 82.2 lies in a vertical plane (as shown in dotted lines in FIG. 3A) and a position where the upper panel 82.3 lies in a vertical plane. With this type of mounting and shape of the side jogger 82, the upper panel 82.3 will tend to hit an edge zone of a section 12 being discharged into the hopper 14 to provide a squaring effect and to guide such a section 12 into the hopper 14. As the section 12 settles in the hopper 14, the central panel 82.1 will continue to provide a squaring effect. Finally, as the section 12 settles lower and starts forming a stack, the lower panel 82.2 will continue the squaring effect.

The rear joggers 84 are of similar shape to the side jogger 82 but are mounted on eccentric mountings 90. The eccentric mountings 90 are such that when the axle 82 is rotatably driven, the rear joggers 84 will be vibrated in an out-of-phase mode so that they are preferably 90 degrees out of phase. They may, however, be operated so that they are 180 degrees out of phase.

By using two rear joggers 84 which are operated out of phase, a more effective squaring action can be provided by these joggers. If a sheet 12 is discharged in an out-of-square position, the one rear jogger 84 will strike the outermost projecting corner and will tend to overcorrect the squaring effect. When the other jogger then comes into operation shortly thereafter, it will tend to correct the overcorrection thereby providing an effective squaring action.

In FIG. 6 a rear view of the receiving heads 14 is shown, with the extraction mechanism of a conventional insertion machine indicated diagrammatically by reference numeral 92. The extraction mechanism 92 operates to select a single section 12 and then extract that selected single section 12 from the bottom of a stack of sections 12 in the receiving hopper 14. Such extracted section is then guided downwardly and inserted into a previously opened outer jacket or section which is held in an aligned pocket of the opener section of the insertion machine 18 in conventional manner.

The feeder apparatus 10 may form an integral part of the insertion machine 18. Alternatively, the feeder apparatus 10 may be an independent unit which is mounted on wheels for displacement to an appropriate location. In yet a further alternative embodiment of the invention, the feeder apparatus 10 may have a receiving hopper or head such as the receiving hopper or head 14 associated therewith as part of the feeder apparatus 10.

The feeder apparatus 10 as illustrated in the drawings can provide the advantage that sheet material sections, particularly folded sheet material sections having various inserts, may be roughly stacked either automatically or manually into bundles 16 and may be conveyed to or placed on the receiving section 20 without any careful or special squaring of the sections 12 in such bundles 16. The feeder apparatus 10 will then operate automatically to elevate and then to supply newspaper sections 12 singularly into the receiving hopper 14 as and when required by the demand switch 14.1. The feeder apparatus 10 provides controlled shingling of the bundles 16 thereby reducing the tendency for insert sections and the like to become displaced during shingling. At the same time, the shingled sections 12 are firmly engaged while they are displaced upwardly along the shingling section 24 and while they are displaced along the discharge section 32.

The sections 12 are forcibly discharged from the discharge section 32. This further assists in preventing inserted sections, particularly sections having smooth or differing textures, from slipping out during discharge of the sections 12 from the discharge section 32.

Because the discharge section 32 depresses the newspaper sections 12 along their central zone, their opposed edges which are contacted by the belt 74 on one side and by the rear joggers 84 on the opposed side, will tend to remain in a raised position relatively to the central zones of the sections 12 even while the belt 74 and the joggers 84 provide a squaring action as the sections 12 fall into the receiving hopper 14. This will therefore reduce the tendency for such edges to be pulled down, particularly by the belts 74. This therefore tends to prevent these edges from slipping down the side of a stack of sections in the receiving hopper 14.

The forcible discharge of the sections 12 from the discharged section 32, together with the squaring action of the belt 74, the side jogger 82 and the rear joggers 84 provides an effective squaring action so that the stack of sections 12 formed in the receiving head 14 will be sufficiently squared for effective extraction by the extraction mechanism 92 during use.

It will be appreciated that the various conveyor belts of the various sections are mounted on pulleys or rollers in conventional manner. The pulleys or rollers are adapted to be driven in accordance with any conventional method. For example, they may be driven by means of a chain and sprocket arrangement with appropriate gearing to allow for the appropriate difference in speed of operation of the various conveyors. The belt systems may also include chain and sprocket arrangements to be driven at the appropriate speeds by a common power source.

If desired, a bridging conveyor system may be provided between the second intermediate section 38 and the shingling section 24 to further insure a smooth conveyance of each bundle 16 from the second intermediate section 38 to the shingling section 24.

In FIGS. 7 to 12 of the drawings an alternative embodiment of a feeder apparatus in accordance with this invention is illustrated. The alternative embodiment of FIGS. 7 to 12 corresponds substantially with the embodiment illustrated in FIGS. 1 to 6. Corresponding parts have therefore been identified by corresponding reference numerals except that the prefix "1" has been included before each reference numeral.

The embodiment of the feeder apparatus 110 is an embodiment which is presently preferred to the embodiment of the feeder apparatus 10 as illustrated in FIGS. 1 through 6 of the drawings.

Figure 7:
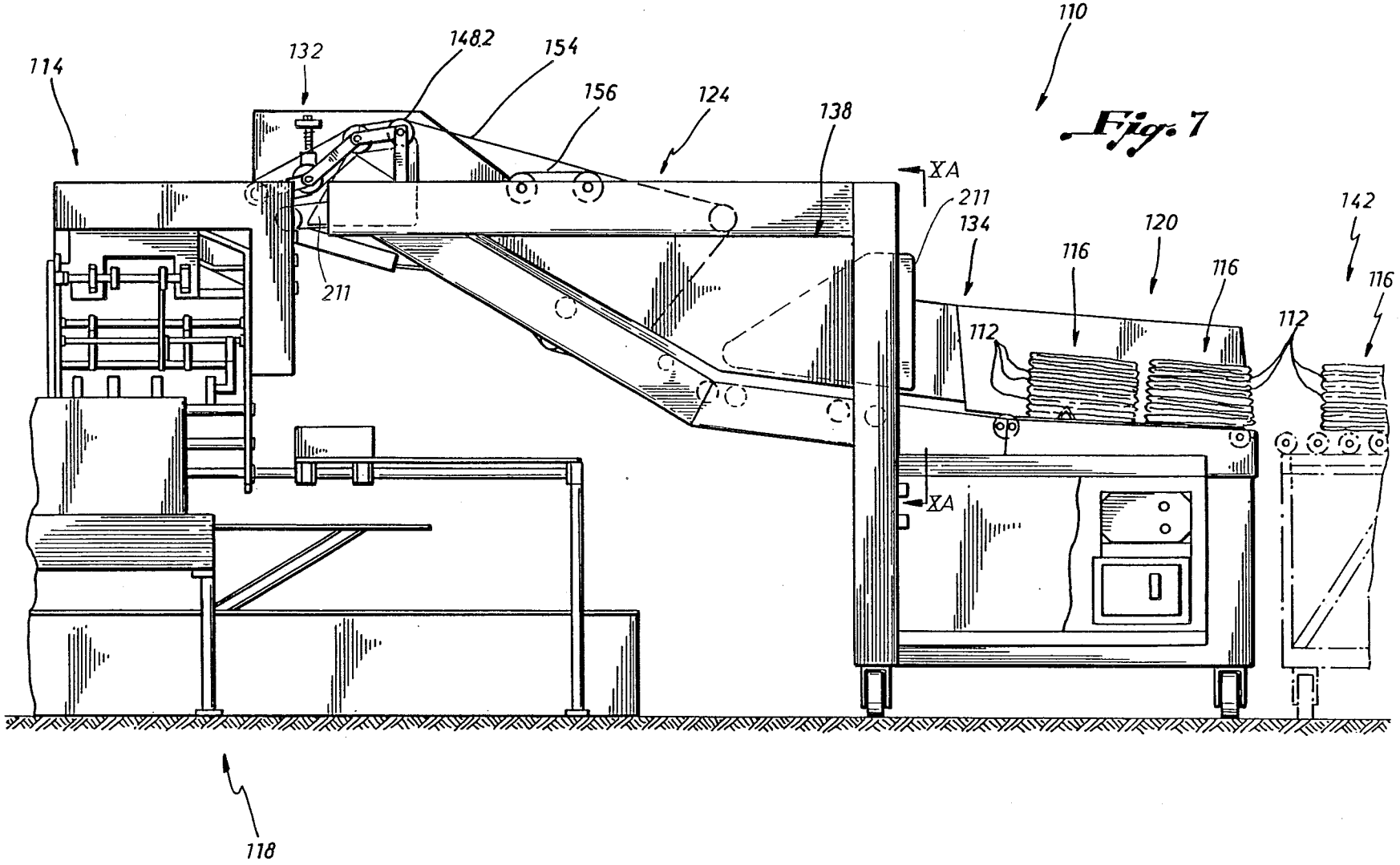
FIG. 7 shows a fragmentary, diagrammatic, side elevation of an alternative embodiment of a feeder apparatus in accordance with this invention, in its operative position for feeding folded newspaper sections into an insertion machine of conventional type.

As can be seen particularly in FIG. 7 of the drawings, the feeder apparatus 110 differs from the feeder apparatus 10 in that two pairs of adjustable guide plates 211 are provided in the apparatus. The adjustable guide plates 211 of each pair are adjustable relatively to each other for the purpose of centering the newspaper sections during advancement through the apparatus 110.

The adjustable guide plates may be adjusted by means of adjusting levers or bolts, or any other suitable means.

In the feeder apparatus 110, the receiving conveyor 122 comprises a pair of conveyor belts; the conveyor system 136 in the first intermediate section 134 comprises 3 conveyor belts; the conveyor system 140 in the second intermediate section 138 comprises 4 conveyor belts; and the shingling conveyor 126 comprises 2 conveyor belts. The discharge section 132 differs more substantially from the discharge section 32 and is described in more detail below.

The feeder apparatus 110 includes an additional roller 213 between the first and second intermediate sections 134 and 138 to make the conveyor system 136 independent of the conveyor system 140. This therefore allows their independent operation when required.

The feeder apparatus 110 further includes a roller 215 which is positioned between the second intermediate section 138 and the shingling section 124. The additional roller 215 makes the conveyor 140 independently operable of the shingling conveyor 126.

A short bridging conveyor belt system 217 is provided to bridge the gap between the roller 215 and the adjacent roller of the shingling conveyor 126.

In the shingling section 124, an additional idler roller 219 is provided on the downstream side of the floating roller 150.2. The idler roller 219 maintains some tension in the shingling conveyor 126 to allow it to give for the first few newspaper sections of any bundle 116 to enter between the shingling conveyor 126 and the floating roller 150.2, and for the newspaper sections 112 which have so entered, to lift the floating roller 150.2 for the remaining newspaper sections 112 to enter into the shingling section 124.

The shingling section 124 further includes an adjustable eccentric 221 which cooperates with the pivot arms 152.2. The eccentric 221 is adjustable to adjust the extent to which the floating roller 150.2 approaches the upper run of the shingling conveyor 126. This adjustment facility insures a sufficient gap to shingle in the bottom few newspaper section 112 of a bundle and thus cause lifting of the floating roller 150.2 for the remaining newspaper sections to enter the shingling section 124 during use.

In the discharge section 132, the discharge conveyor belt system 44 of the feeder apparatus 10 has been replaced by a discharge spring system 144 comprising a plurality of helical spring belts which are mounted on appropriately grooved rollers 225 and 227.

The discharge section 132 further comprises a discharge roller 229 which is operatively associated with the idler roller 148.1 by means of a discharge helical spring system 146.

Figures 8, 9:
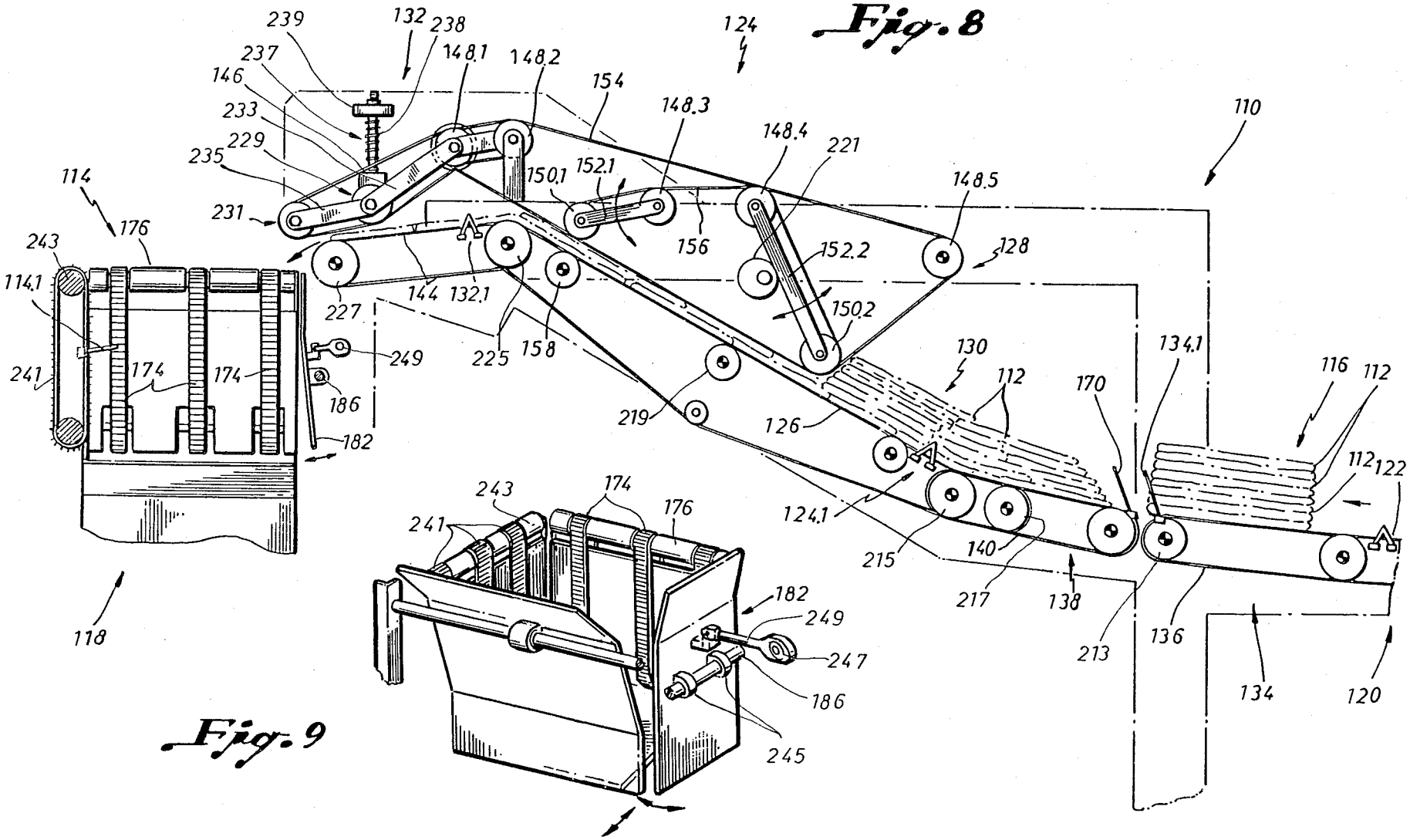
FIG. 8 shows a fragmentary, diagrammatic, side elevation of part of the feeder apparatus of FIG. 7, with cover plates and frame sections omitted for the sake of clarity.
FIG. 9 shows a diagrammatic, fragmentary oblique view from the rear and from one side, of the receiving hopper or head of the insertion machine of FIGS. 7 and 8.
Figure 10B:
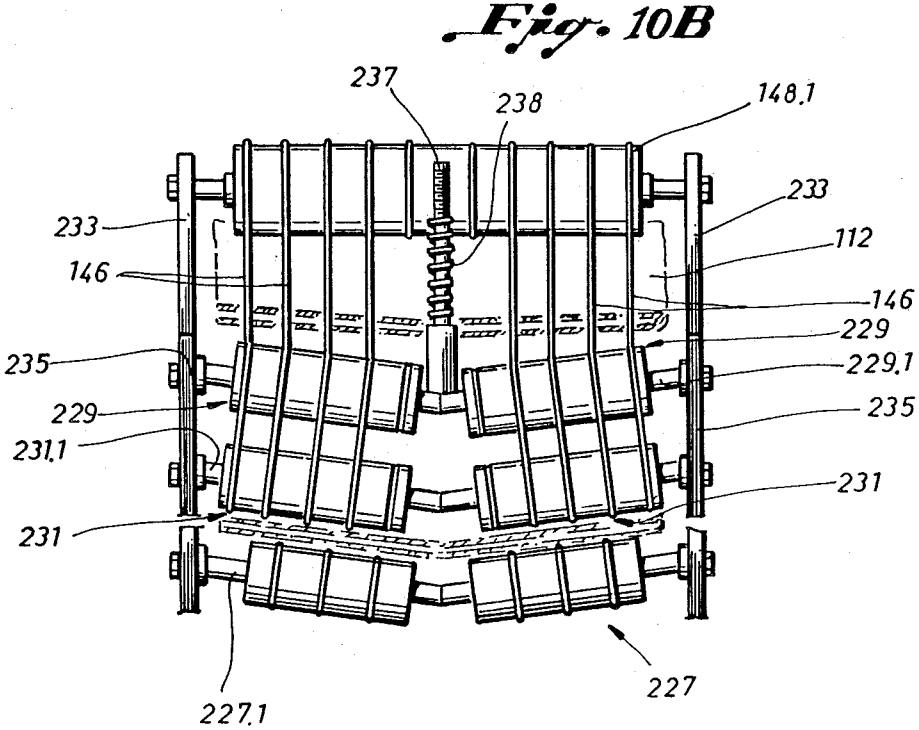
FIG. 10B shows a fragmentary diagrammatic front view of the feeder apparatus of FIG. 7, of the discharge end of the discharge section of that apparatus.
Figure 10A:
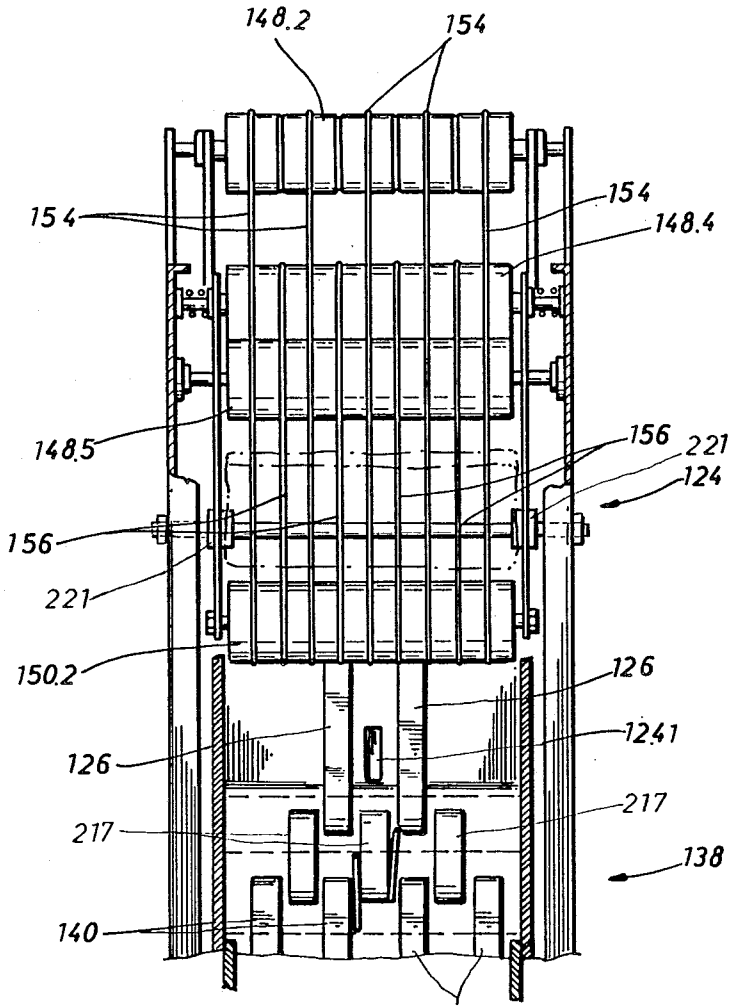
FIG. 10A shows a fragmentary view of the feeder apparatus along the line and in the direction of the arrows associated with the line XA—XA in FIG. 7.
Figure 12:
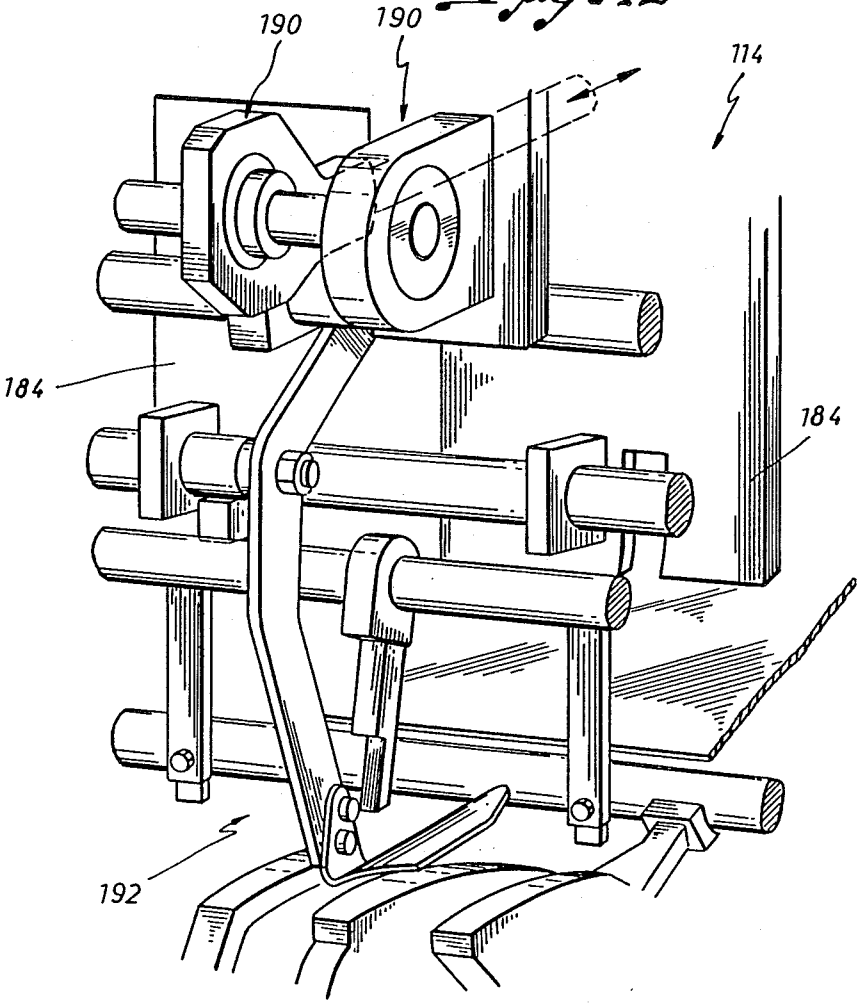
FIG. 12 shows, to an enlarged scale, an oblique rear view of the receiving head of FIG. 11.
Figure 11:
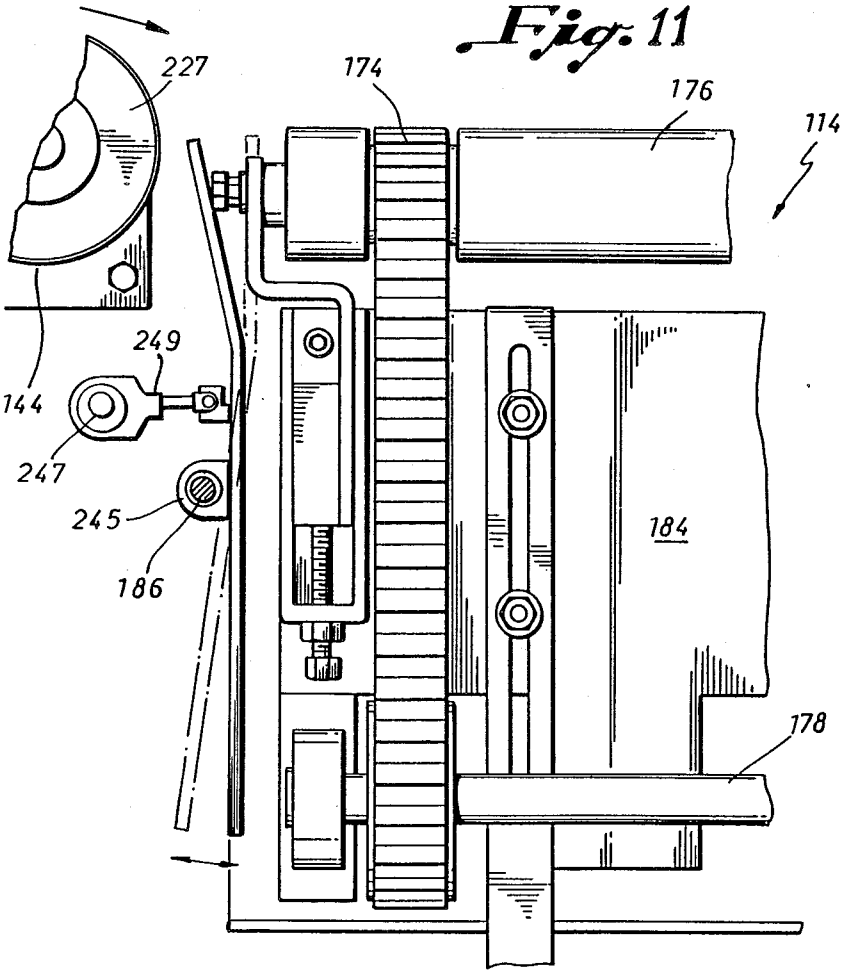
FIG. 11 shows, to an enlarged scale, a fragmentary side elevation of the receiving head or hopper of FIG. 9 associated with the feeder apparatus.

As can be seen particularly in FIGS. 8 and 10B of the drawings, the discharge section 132 further includes a lead roller 231. This lead roller 231 is an optional roller and may, if desired, be omitted entirely. The spring system 146 also cooperates with the roller 231.

The discharge roller 229 is supported in the apparatus 110 by means of a pair of support arms 233. The optional lead roller 231, when provided, is supported in the discharge section 132 by means of a pair of support arms 235 which connect it to the discharge roller 229.

Each of the discharge roller 229, optional lead roller 231 and lower roller 227, comprises a pair of rollers mounted on a bent shaft 229.1, 227.1 and 231.1.

The rollers of each pair can therefore rotate on the respective sections of their bent shafts to thereby impart a V-section configuration to newspaper sections as they pass through the discharge section 132 and are discharged therefrom into the receiving hopper 114. The discharge section 132 therefore discharges newspaper sections 112 in substantially the same way as the discharge section 32.

The discharge helical spring system 146 is normally driven relatively to the discharge spring system 144 so that the newspaper sections tend to be lifted as they emerge from the discharge section 132 thereby insuring that their leading ends do not tend to dip unduly into the receiving hopper 114 upon discharge into the hopper.

The discharge section 132 further includes an adjustment stud 237 which is mounted on the shaft 229.1 and has its upper end associated with a cross plate (not shown) mounted upon the frame of the feeder apparatus 110. A helical spring 238 is mounted on the stud, and a nut 239 is provided for adjusting the extent of compression of the spring 238. By adjusting the nut 239 the bias action of the spring 238 can be adjusted to adjust the extent to which the roller 229 is biased downwardly during use.

The receiving hopper 114 differs from the hopper 14 in certain respects. The sidewall 72 of the hopper 14 is provided with ribbed belts 241 which are driven during use to engage with and draw the leading ends of newspaper sections 112 fed into the hopper 140, downwardly as they are fed in. These ribbed belts therefore serve the same function as the belts 174 and are conveniently driven off a common driving source.

The rollers 176 and 243 on which these belts are mounted, are grooved to reduce the tendency for newspaper sections to hit the edges of the belts at the top of the rollers 176 and 243 during use.

The side jogger 182 of the hopper 140 has a different shape than the side jogger 82. It is mounted on an axle 186. The feeder apparatus 110 include two axially spaced bearings 245 which are mounted on the side jogger 182 and rotatably support the axle 186.

The apparatus 110 further includes an eccentric driven shaft 247 which is adapted to be rotatably driven to drive the side jogger 182. The side jogger 182 has a jogging arm 249 which is pivotally connected to the jogger and is mounted from the eccentric shaft 247. When the shaft 247 is driven, the jogger 182 will provide a jogging motion.

In the apparatus 110 the control switch 24.2 has been omitted entirely. Furthermore, the operation of the system is controlled so that a bundle 116 on the first intermediate section 134, will not cross the back stop 170 before it is actually required. There is, therefore, an appropriate time delay on the operation of the conveyor system 136 during use.

The feeder apparatus 110 operates in substantially the same way as the feeder apparatus 10. Applicant believes, however, that the feeder apparatus 110 is of simpler construction and should therefore be more reliable and effective during use.

In FIGS. 13 to 17 of the drawings, an alternative embodiment of the feeder apparatus in accordance with this invention is illustrated. The alternative embodiment of FIGS. 13 to 17 corresponds substantially with the embodiment illustrated in FIGS. 1 to 6. Corresponding parts have therefore been identified by corresponding reference numerals except that the prefix "3" has been included before each reference numeral.

The embodiment of the feeder apparatus 310 is the presently preferred embodiment of the three embodiments illustrated in the drawings.

Figure 13:
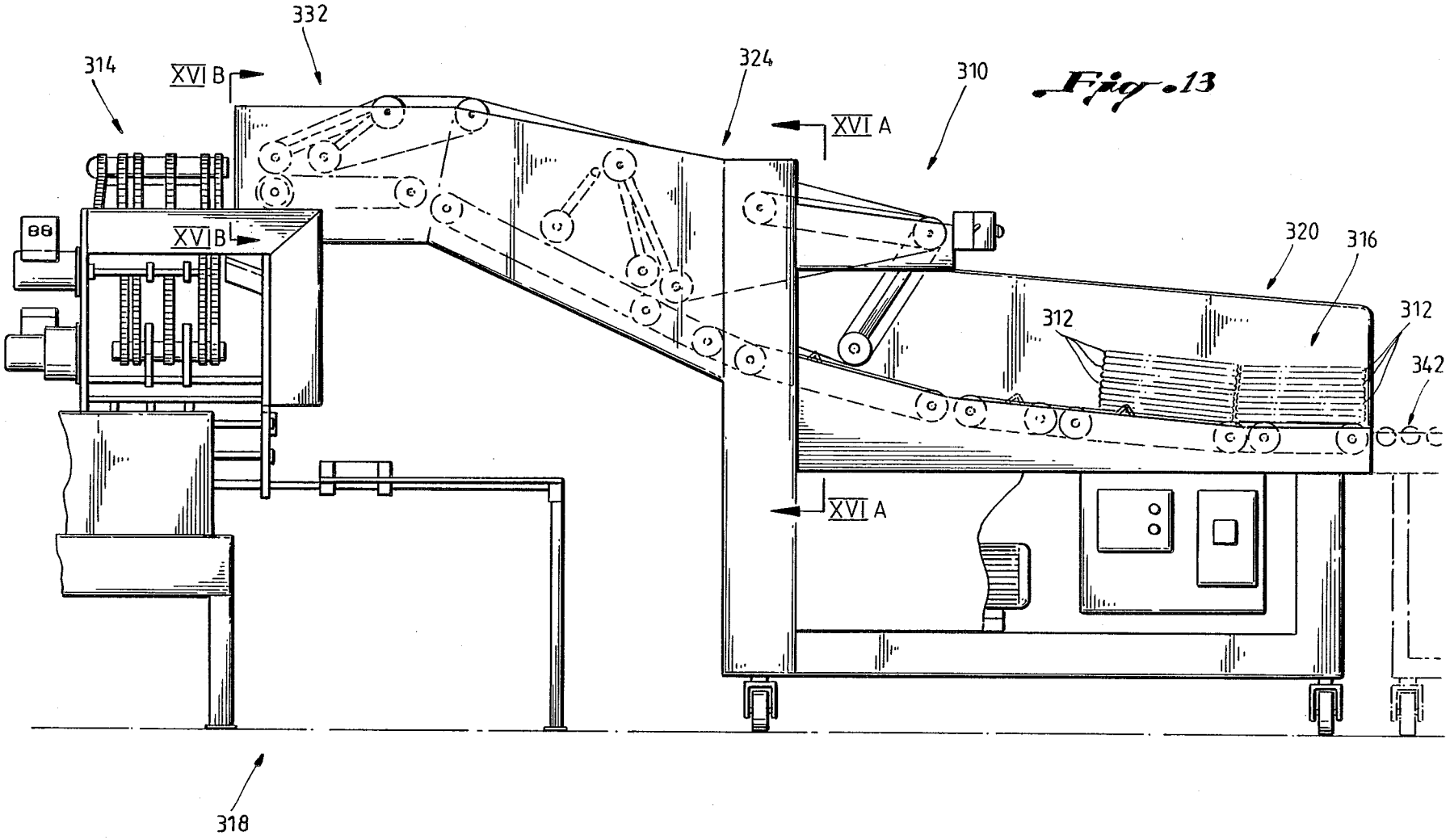
FIG. 13 shows a fragmentary, diagrammatic, side elevation of a preferred embodiment of a feeder apparatus in accordance with this invention, in its operative position for feeding folded newspaper sections into an insertion machine of conventional type.
Figure 14:
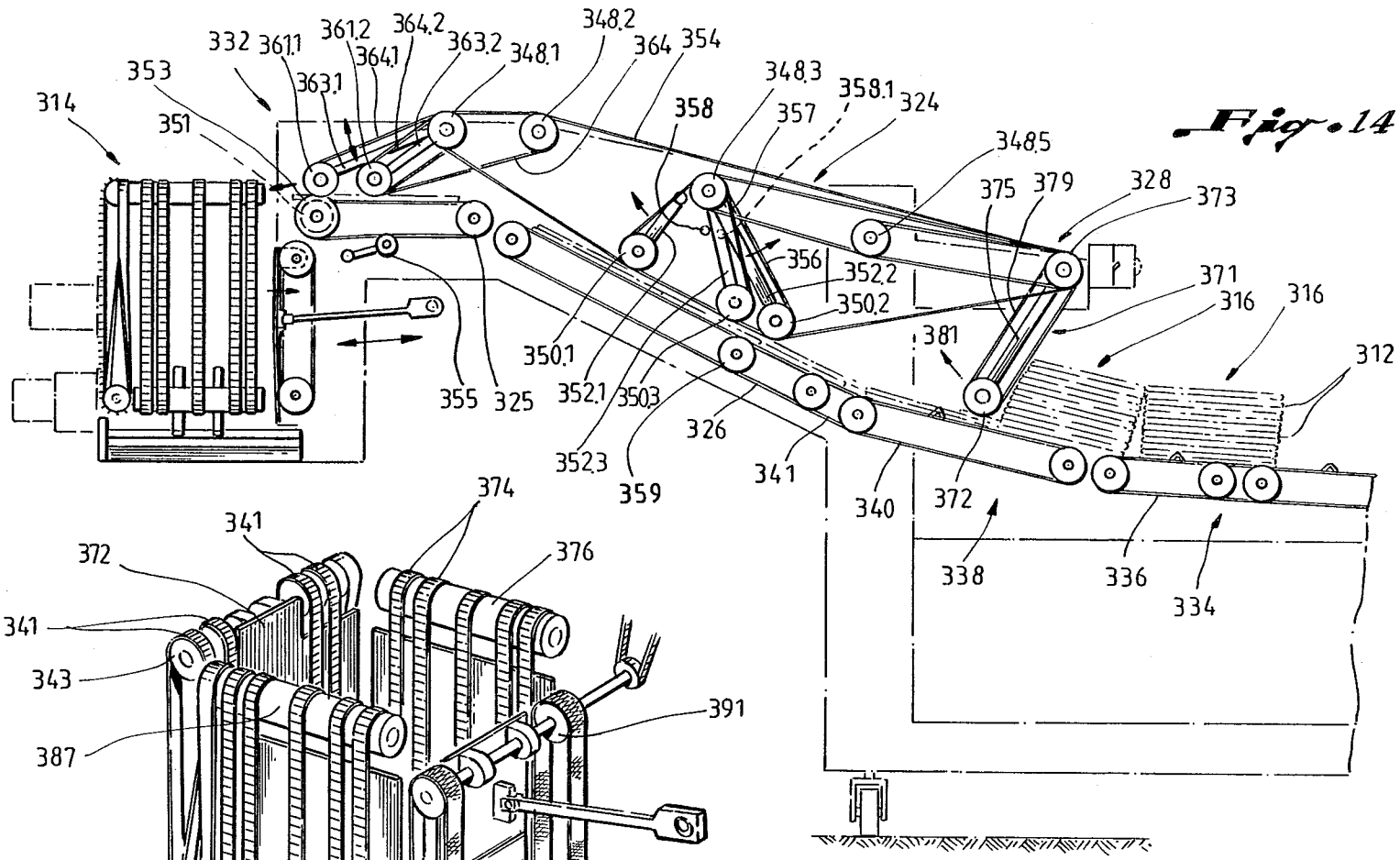
FIG. 14 shows a fragmentary, diagrammatic, side elevation of part of the feeder apparatus of FIG. 13, with cover plates and frame sections omitted for the sake of clarity.

As can be seen by comparing FIGS. 1 and 13, the basic differences between the two embodiments are in the shingling sections 24 and 324, and in the discharge sections 32 and 332. Feeder apparatus 310 still includes a receiving section 320 onto which bundles 316 of stacked sheet material sections 312 can be loaded. As can be seen with reference to FIG. 14, bundles 316 are transported through intermediate sections 334 and 338 by conveyors 336 and 340. An intermediate conveyor 341 is provided between conveyor 340 in intermediate section 338 and conveyor 326 in shingling section 324.

As bundles 316 enter the shingling section, they encounter a hold down arm 371 which is pivotally connected to the axle supporting of idler roller 373. Idler roller 373 is divided into halves such that hold down arm 371 can be connected in the center of the axle and thus, in the center of feeder apparatus 310. Hold down arm 371 includes an arm 375, an idler roller 377 and a helical spring belt 379.

As bundles 316 engage hold down arm 371, they cause arm 371 to pivot upwardly in the direction indicated by arrow 381. Hold down arm 371 provides a force against the top of bundle 316 to prevent it from toppling backwards as it enters the shingling section to prevent the stacked sheet material 312 from becoming disarranged and to prevent inserts from sliding out of place.

The sheet material sections 312 are consecutively removed from the bottom of bundle 316 by shingling conveyor 326 and transported through the shingling section. Floating rollers 350.1, 350.2 and 350.3 apply pressure to the tops of the shingled sections to hold them in a fixed relationship and to prevent the inserts from becoming dislodged as they pass through feeder apparatus 310.

Floating roller 350.1 is supported by a pivot arm 352.1, floating roller 350.2 is supported by a pivot arm 352.2 and floating roller 350.3 is supported by a pivot arm 352.3. A plurality of helical spring belts 357 encircle rollers 350.1, 350.3 and 348.3. These helical spring belts 357 cause floating rollers 350.1 and 350.3 to be biased downward such that they engage the top of the shingled sheet material sections. However, inasmuch as the helical spring belts are stretchable, rollers 350.1 and 350.3 can be pivoted upwardly as indicated by the arrows in FIG. 14 when thicker sheet material sections are being shingled. Accordingly, the present invention provides a means for automatically adjusting the distance between conveyor 326 and the rollers to accommodate sheet material sections of different thicknesses. A plurality of helical spring belts 356 encompass rollers 350.1, 350.2 and 348.3 in a similar fashion.

A stop 358 is provided in the wall of feeder 310 to catch arm 352.3 and thus prevent roller 350.3 from engaging the bottom of the shingling section. Accordingly, there is always at least a small distance between roller 350.3 and the bottom of the shingling section to prevent sections 312 from becoming jammed. A similar stop 358.1 is provided for arm 352.2 and roller 350.2.

A roller 359 is positioned below conveyor 326 between rollers 350.2 and 350.3. Roller 359 causes the sections 312 to rise slightly as they enter the shingling section to prevent jamming.

The other major difference between the embodiment illustrated in FIGS. 13 to 17 and the embodiment illustrated in FIGS. 1 to 6 is in the discharge section 332. In the embodiment of FIGS. 1 to 6 and also in the embodiment of FIGS. 7 to 12, the sheet material sections 12 and 112 are discharged with the center portion slightly depressed such that the side edges are angled slightly upward. However, in the discharge section 332 of FIGS. 13 to 17, sheet material sections 312 are discharged with their side edges in a substantially horizontal plane. Thus, as sections 312 enter receiving hopper 314 the side edges are perpendicular to the walls of receiving hopper 314 rather than being angled.

Figure 16B:
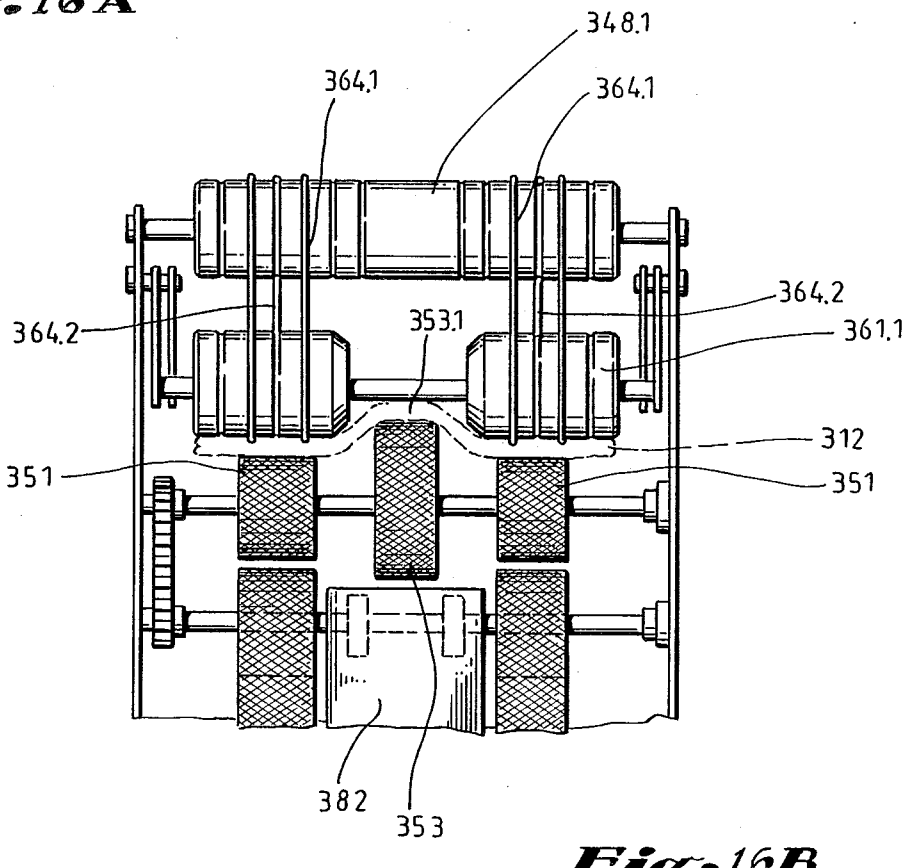
FIG. 16B shows a fragmentary diagrammatic front view of the discharge end of the discharge section of the feeder apparatus of FIG. 13.
Figure 16A:
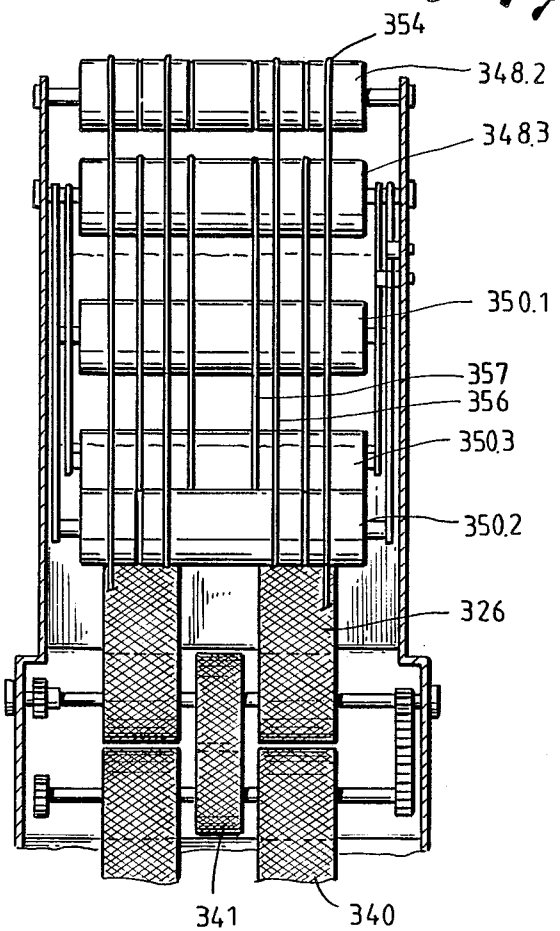
FIG. 16A shows a fragmentary view of the feeder apparatus along the line and in the direction of the arrows associated with the line XVI—XVI in FIG. 13.

However, in order to facilitate passage of sheet material sections 312 into receiving hopper 314, it has been found advantageous to temporarily reduce the width of the sections 312 so that the edges do not prematurely engage the sides of receiving hopper 314. In the preferred embodiment, this is accomplished by creating a small hump essentially along the centerline of the sections as they pass through discharge section 332. This is best illustrated in FIG. 16B. Rollers 351 and 353 rotate about the same axis. However, roller 353 which is positioned between rollers 351 is slightly larger in diameter. Accordingly, as sheet material section 312 passes over rollers 351 and 353, rollers 353 causes the center portion of sheet material section 312 to be forced upwardly. The small hump 353.1 which is created in sheet material section 312 causes the side edges of section 312 to be drawn inwardly.

Discharge roller 361.1 is split into two halves to correspond to rollers 351. The center portion is removed to provide room for the hump 353.1 to be formed. Roller 361.2 (see FIG. 14) is also divided similar to roller 361.1 to allow the hump to be formed along the entire length of the section 312. As the newspaper sections 312 are discharged from the end of feeder apparatus 310, the forces created by rollers 361.1, 351 and 353 are released such that section 312 can be spring back to its normally flat configuration. However, at the time the forces are completely removed from a section 312, the section is substantially within receiving hopper 314 such that the edges of section 312 cannot prematurely strike the sides of the hopper.

A helical spring belt 364.1 surrounds rollers 361.1, 361.2, 348.2 and 348.1. A helical spring belt 364.2 surrounds rollers 361.2, 348.2 and 348.1. Inasmuch as helical spring belts 364.1 and 364.2 can be stretched, rollers 361.1 and 361.2 can pivot upwardly on arms 363.1 and 363.2 respectively when thick sheet material sections 312 pass through discharge section 332. Additionally, the tension in belts 364.1 and 364.2 cause rollers 361.1 and 361.2 to be urged generally downward on the top of the sheet material sections 312 to force them against rollers 351 and 353 while the sheet material sections are being discharged.

Figure 15:
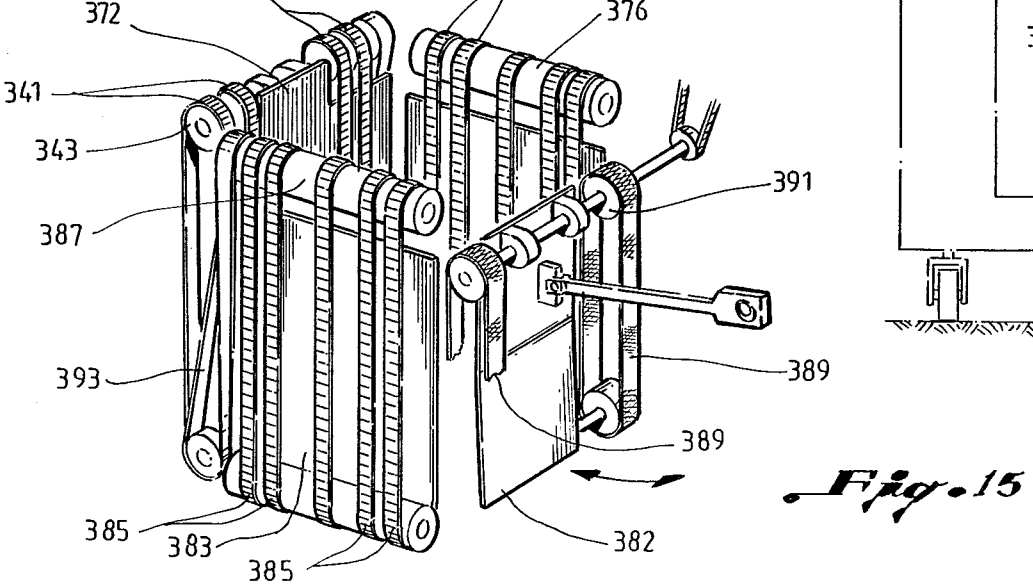
FIG. 15 shows a diagrammatic, fragmentary oblique view from the rear and from one side, of the receiving hopper or head of the insertion machine of FIGS. 13 and 14.
Figure 17:
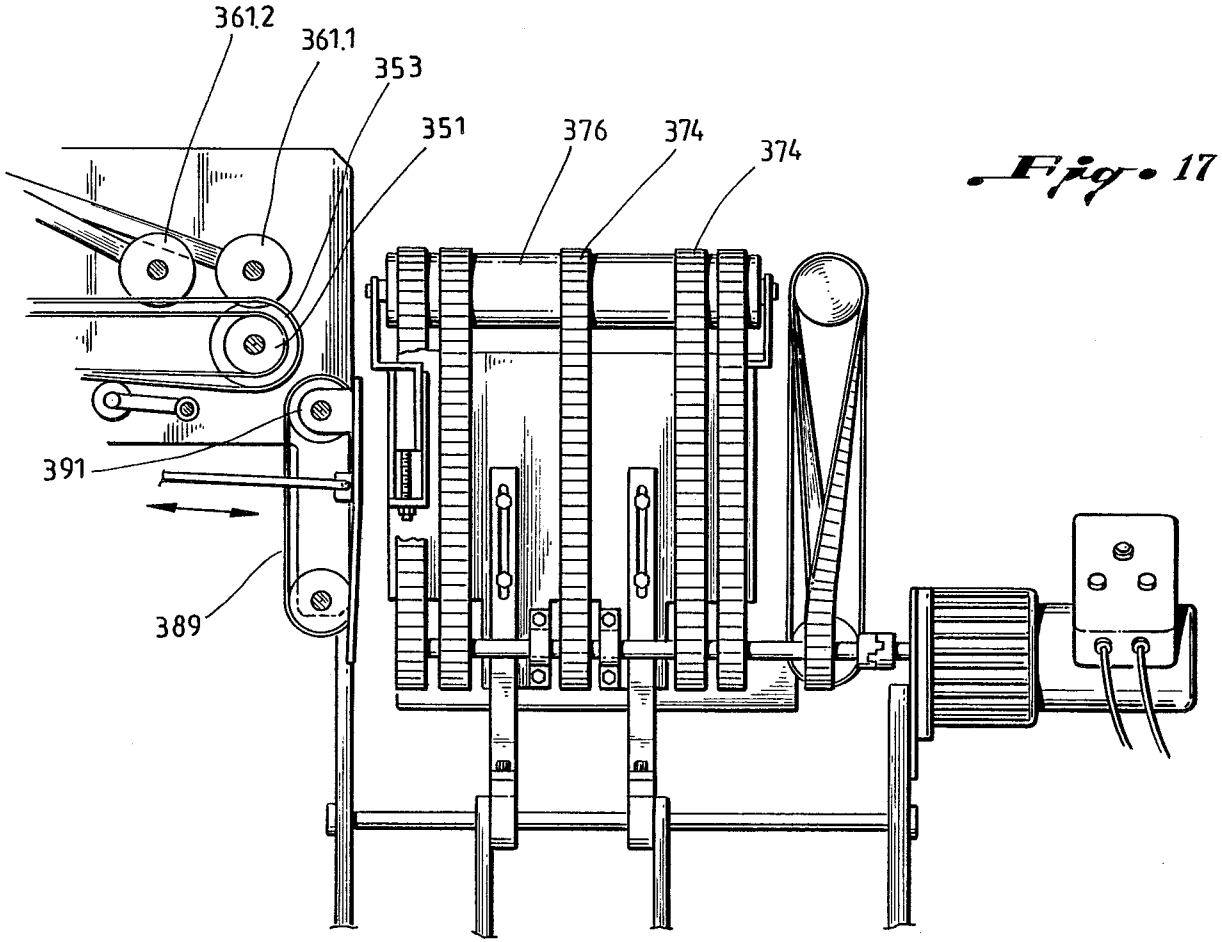
FIG. 17 shows to an enlarged scale, a side elevation of the receiving head or hopper of FIG. 13 associated with the feeder apparatus.

Reference is next made to FIGS. 15 and 17 which illustrate the preferred embodiment of receiving hopper 314.

Receiving hopper 314 is similar to receiving hopper 114 of FIG. 9 in that side wall 372 utilizes ribbed belts 341 as well as the ribbed belts 374 which are on the front wall. However, in the embodiment illustrated in FIG. 15, rear wall 383 includes ribbed belts 385 in place of rear joggers 84 or 184. The ribbed belts 385 cooperate with the ribbed belts 374 on the front side of receiving hopper 314 to grab the sides of the sheet material sections 312 as they enter the hopper to direct them to the bottom of the hopper in alignment.

Receiving hopper 314 also includes ribbed belts 389 which are positioned along the sides of the side jogger 382. These ribbed belts are driven by roller 391 and also help direct the sheet material sections to the bottom of the hopper in alignment. The ribbed belts on the various sides of receiving hopper 314 can be driven simultaneously by a number of methods such as by a drive belt 393 which connects opposing rollers from adjacent sides. In the preferred embodiment, the ribbed belts are stopped when sections 312 are not being fed into hopper 314.

As can be seen from the foregoing, the present invention provides a unique method for feeding sheet material sections into a receiving hopper or head wherein the sections can be stacked and squared with minimal handling by hand. Additionally, the invention provides a means for stacking the sheet material sections without dislodging inserts which may be contained within those sections.

It will of course be appreciated that various modifications can be made to the illustrated embodiments including interchanging various sections from the illustrated embodiments. Additionally, it is possible to build a feeder apparatus in which the discharge section, the shingling section and the receiving section lie in a substantially horizontal plane. However, the incline disclosed in the illustrated embodiments has been found useful when the feeder apparatus is used to load newspaper sections into a head of a conventional insertion machine.

While the present invention has been illustrated with respect to the presently preferred embodiments, it will be appreciated that other modifications and changes can be made without departing from the spirit and scope of the invention. Accordingly, all changes and modifications which come within the meaning and range of equivalency of the claims are to be embraced within their scope.

What is claimed is:

1. Feeder apparatus for feeding sheet material sections successively into a receiving hopper from a bundle of stacked sheet material sections, the apparatus comprising:

(a) a shingling section including a shingling conveyor for receiving such a bundle and conveying such a bundle along the shingling section, and including a shingling belt system to engage such a bundle being conveyed by the shingling conveyor, the shingling belt system and shingling conveyor operating cooperatively to contact the handle and shingle the sheet material sections of such a bundle into a shingled arrangement, the shingling conveyor and shingling belt system being arranged to engage such a shingled, arrangement between them and advance such arrangement in an engaged condition along the shingling section, and (b) a discharge section for receiving such a shingled arrangement from the shingling section, and for discharging such sheet material sections successively into a receiving hopper.

2. Feeder apparatus according to claim 1, including a receiving section for initially receiving such bundles of stacked sheet material, the receiving section including a receiving conveyor for advancing such bundles towards the shingling section.

3. Feeder apparatus according to claim 2, in which the shingling section includes a hold down arm for engaging a bundle as it enters the shingling section to prevent the bundle from toppling over.

4. Feeder apparatus according to claim 4, in which the discharge section includes a discharge conveyor and a discharge belt system to cooperate for engaging such a shingled arrangement between them and for conveying it for discharge of successive sheet material sections into a receiving hopper.

5. Feeder apparatus according to claim 4, in which the discharge belt system comprises an extension of the shingling belt system.

6. Feeder apparatus according to claim 4, in which the discharge conveyor slopes downwardly towards a discharge end of the discharge section.

7. Feeder apparatus according to claim 4, in which the discharge conveyor discharges the sheet material sections in a substantially horizontal plane.

8. Feeder apparatus according to claim 2, in which the shingling belt system includes at least one shingling roller which is resiliently biased towards the shingling conveyor for the shingling belt system to squeeze shingled sections between it and the shingling conveyor.

9. Feeder apparatus according to claim 8, in which the shingling conveyor has conveyor belts which are supported by spaced rollers to be capable of yielding in the zone of the shingling roller to provide a yieldable throat zone between the shingling conveyor and the shingling roller.

10. Feeder apparatus according to claim 2, including at least one intermediate section between the receiving section and the shingling section to convey bundles from the receiving section to the shingling section.

11. Feeder apparatus according to claim 10, in which the intermediate section forms a gradual transition slope between the receiving section and the shingling section to prevent toppling of a bundle while being conveyed from the receiving section to the shingling section.

12. Feeder apparatus according to claim 11, in which the shingling conveyor slopes upwardly at an angle of about 30° to ensure that bundles can be conveyed up the slope without toppling.

13. Feeder apparatus according to claim 12, in which the receiving conveyor extends generally horizontally.

14. Feeder apparatus according to claim 12, in which the receiving conveyor slopes upwardly at an angle of not more than about 4°.

15. Feeder apparatus according to claim 11, in which the intermediate section comprises first and second intermediate sections with the first section having a slope of no more than about 5° and with the second section having a slope of about 10°.

16. Feeder apparatus according to claim 10, in which the intermediate section comprises a first intermediate section followed by a second intermediate section.

17. Feeder apparatus according to claim 16, in which the receiving section has a length of at least two sheet material sections to be handled in the apparatus, in which the first and second intermediate sections and the discharge section each have a length slightly larger than the length of a sheet material section to be handled in the apparatus, and in which the shingling section has a length at least about double the length of a sheet material section to be handled by the apparatus.

18. Feeder apparatus according to claim 16, including means whereby each section of the apparatus is adapted to be driven marginally faster than its preceding section during use.

19. Feeder apparatus according to claim 4, in which the discharge section includes to discharge each sheet material section with its central zone in the direction of movement of such sheet material section being depressed below its opposed edges.

20. Feeder apparatus according to claim 4, in which the discharge section is adapted to discharge each sheet material section with its central zone in the direction of movement of such sheet material being raised to form a hump such that the width of said sheet material is temporarily reduced while maintaining the sheet material in a substantially planar, horizontal configuration.

21. Feeder apparatus according to claim 4, including a receiving hopper for receiving sheet material sections discharged from the discharge section.

22. Feeder apparatus according to claim 21, in which the receiving hopper comprises a receiving head of an insertion apparatus for receiving a stack of sheet material sections.

23. Feeder apparatus according to claim 22, in which the receiving hopper includes a side jogger positioned adjacent the discharge end of the discharge conveyor for jogging sheet material sections discharged into the hopper.

24. Feeder apparatus according to claim 23, in which the side jogger has a central panel, a rearwardly angled upper panel and a rearwardly angled lower panel.

25. Feeder apparatus according to claim 24, in which the side jogger is mounted on an axle positioned about 2/5ths of the way from the upper edge of the side jogger, and in which the side jogger is adapted to be jogged during use between an advanced position where its upper panel is generally vertical, and a retracted position where its lower panel is generally vertical.

26. Feeder apparatus according to claim 22, in which the receiving hopper includes a pair of adjacent rear panels which are adapted to be jogged out of phase relatively to each other.

27. Feeder apparatus according to claim 26, in which the rear joggers are adapted to be jogged out of phase with a phase difference of between about 90° and about 180°.

28. Feeder apparatus according to claim 21, in which the receiving hopper includes at least one side having ribbed, movable belts for directing the sheet material sections to the bottom of said hopper.

29. Feeder apparatus according to claim 28, in which the receiving hopper includes at least three sides having ribbed, movable belts for directing the sheet material section to the bottom of said hopper.

30. An automatic feeder apparatus for feeding sheet material sections to a receiving hopper from bundles of stacked sheet material sections, the apparatus comprising:

(a) a receiving section having a receiving conveyor for receiving such bundles of stacked sheet material sections, and for conveying such bundles to an exit zone of the receiving section;

(b) a shingling section having an upwardly sloping squeeze conveyor to raise bundles reaching it from the receiving section, and having a shingling belt system to cooperate with the squeeze conveyor to contact a bundle being advanced upwardly by the squeeze conveyor to cause such bundle to form a shingled arrangement, and to engage such a shingled arrangement between it and the squeeze conveyor and advance such a shingled arrangement upwardly; and (c) a discharge section having cooperating discharge conveyor and discharge belt systems for receiving such a shingled arrangement from the shingling section between them, and for discharging the sheet material sections of such an arrangement successively into a receiving hopper.

* * * * *

UNITED STATES PATENT AND TRADEMARK OFFICE

CERTIFICATE OF CORRECTION

PATENT NO. : 4,783,065

DATED : November 8, 1988

INVENTOR(S) : Glen L. Graves, Sr.

It is certified that error appears in the above-identified patent and that said Letters Patent is hereby corrected as shown below:

Col. 18, line 7, please delete "handle" and insert therefor --bundle--.

Col. 18, line 27, please delete "claim 4" and insert therefor --claim 2--.

Col. 19, line 27, after "includes" please insert --means--.

Signed and Sealed this

Twenty-seventh Day of June, 1989

*Attest:*

DONALD J. QUIGG

*Attesting Officer*

*Commissioner of Patents and Trademarks*